US008532518B2

(12) United States Patent
Torimaru

(10) Patent No.: US 8,532,518 B2
(45) Date of Patent: Sep. 10, 2013

(54) IMAGE FORMING APPARATUS

(75) Inventor: Yuusuke Torimaru, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 181 days.

(21) Appl. No.: 13/191,707

(22) Filed: Jul. 27, 2011

(65) Prior Publication Data

US 2012/0027442 A1 Feb. 2, 2012

(30) Foreign Application Priority Data

Jul. 29, 2010 (JP) ..... 2010-170286
Jul. 29, 2010 (JP) ..... 2010-170287

(51) Int. Cl.
*G03G 15/047* (2006.01)
*G03G 15/00* (2006.01)
*G03G 13/045* (2006.01)

(52) U.S. Cl.
USPC ..... 399/72; 399/44; 399/169

(58) Field of Classification Search
USPC ..... 399/49, 72, 169
See application file for complete search history.

(56) References Cited

U.S. PATENT DOCUMENTS 5,751,437 A * 5/1998 Parker et al. ..... 358/300
5,978,628 A * 11/1999 Rees ..... 399/178
7,593,675 B2 * 9/2009 Kimura et al. ..... 399/296
7,773,902 B2 8/2010 Takayanagi
7,787,810 B2 * 8/2010 Kerxhalli et al. ..... 399/301
7,929,874 B2 * 4/2011 Takiguchi et al. ..... 399/34
8,135,302 B2 * 3/2012 Sato et al. ..... 399/99
2008/0267648 A1 10/2008 Takayanagi
2008/0292338 A1 * 11/2008 Fujiwara ..... 399/44
2011/0142502 A1 6/2011 Torimaru

FOREIGN PATENT DOCUMENTS

JP 2008-122625 A 5/2008
JP 2008-129472 A 6/2008

* cited by examiner

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

An image forming apparatus includes an image bearing member; an image forming portion for forming a toner image on the image bearing member, the image forming portion being capable of forming an image to be formed on a recording material and forming a control image for controlling an image density at a position adjacent to the image to be formed on the recording material; an intermediary transfer member rotatable while carrying the toner image transferred from the image bearing member; a transfer member for forming a transfer portion where the toner image is to be transferred from the intermediary transfer member onto the recording material; an electrostatic cleaning member for electrostatically removing the toner deposited on the transfer member; a density detecting portion, provided upstream of the transfer member with respect to a rotational direction of the intermediary transfer member, for detecting a density of the control image transferred on the intermediary transfer member; an adjusting portion for adjusting an image forming condition of the image forming portion depending on an output of the density detecting portion; and a charge amount changing portion for adjusting a charge amount of the control image transferred onto the intermediary transfer member.

7 Claims, 22 Drawing Sheets

(a)

(b)

| BSS WGHT g/m2 | 62~99 | 100~180 | 181~250 |
|---|---|---|---|
| 2ND TRNSFR VOL. kV | -2 | -2.5 | -3 |
| CHRGR CRRNT μA | -6 | -7.5 | -9 |

| PTCH INPT SGNL | C0h | B0h | A0h | 90h | 70h | 50h | 40h | 30h | 20h | 10h |
|---|---|---|---|---|---|---|---|---|---|---|
| CHRGR CRRNT μA(HH) | -4 | -4 | -4 | -3.5 | -3 | -2.5 | -2 | -2 | -2 | -2 |
| CHRGR CRRNT μA(NN) | -6 | -6 | -6 | -5.5 | -4.5 | -3.5 | -3 | -2.5 | -2 | -2 |
| CHRGR CRRNT μA(NL) | -8 | -8 | -8 | -7 | -6 | -5 | -4 | -4 | -3 | -2 |

| A3(SHEETS) | | 5 | 10 | 100 | 1000 |
|---|---|---|---|---|---|
| BCK CNT-MNTN | NO PTCH CHRGNG | ○ | △ | × | × × |
| | WITH PTCH CHRGNG | ○ | ○ | ○ | ○ |

(a)

(b)

| | STATE | | CHRG AMNT | PAPER SIZE | PATCH |
|---|---|---|---|---|---|
| | FRONT | REAR | | | |
| (1) | 500c open<br>500a | 500d open | LOW | OVER-LARGE | S.I. OR ON PPR |
| (2) | 500c close | 500d open<br>500a | NRML | UP TO LARGE | SIDE |
| (3) | 500c open<br>500a | 500d close | HIGH | UP TO LARGE | SIDE |
| (4) | 500c close | 500d close | NRML | ALL | S.I. |

FIG.26

IMAGE FORMING APPARATUS

FIELD OF THE INVENTION AND RELATED ART

The present invention relates to an image forming apparatus such as a copying machine, a printer, a facsimile machine or a multi-function machine having a plurality of functions of these machines. More specifically, the direction relates to the image forming apparatus, of an electrophotographic type or an electrostatic recording type, in which a patch as a control image (image for control) is formed and an image density is controlled.

In a conventional image forming apparatus of the electrophotographic type, in general, the surface of a drum-like photosensitive member as an image bearing member is uniformly charged by a charger and the charged photosensitive member is exposed to light by an exposure device depending on image information to form an electrostatic latent image on the photosensitive member. The electrostatic latent image formed on the photosensitive member is visualized as a toner image with a toner as a developer by using a developing device. Then, the visualized image is transferred onto the recording material. Thereafter, the toner image transferred on the recording material is melt-fixed on the recording material under heat and pressure by a fixing device.

In such an image forming apparatus, in order to control a density and gradation of the image, it has been conventionally practiced that the control image (patch) is formed separately from a normal image which is an image based on image data and the density of the patch is detected. The patch is formed between output images (normal images) in general. That is, as shown in FIG. 20, a plurality of patches β different in density are formed between an output image α Band an output image α which are formed on a photosensitive drum 1 which is the photosensitive member. Then, these patches β formed between the images are detected by a density detecting sensor and a detection result is fed back to an image forming condition for charging, exposure, development and the like, so that control of the density and gradation of the output image is effected. Further, in the case where the patch is detected on the photosensitive drum 1 and between the images, in order to alleviate a cleaning load at a downstream side, a bias (reverse bias) of an identical polarity to a toner charge polarity is applied to a transfer means. As a result, most of the patches can be sent to a cleaning means for removing the toner on the photosensitive drum 1. In the case of a structure in which the toner image is primary-transferred from the photosensitive drum onto an intermediary transfer belt as an intermediary transfer member and then is secondary-transferred from the intermediary transfer belt onto the recording material, a structure in which the toner remaining on the intermediary transfer belt is electrostatically removed has been known. For example, a fur brush is disposed downstream of a secondary transfer portion of the intermediary transfer belt and electrostatically attracts and removes the toner remaining on the intermediary transfer belt (Japanese Laid-Open Patent Application (JP-A) 2008-129472). Incidentally, in the case of a structure described in JP-A 2008-129472, in order not to transfer the patches onto the intermediary transfer belt, a bias of an opposite polarity to that for the normal image is applied when the patches reach a primary transfer portion.

Further, with respect to a structure including the intermediary transfer belt, a structure in which an untransferred toner image such as the patch transferred on the intermediary transfer belt is charged and a collecting efficiency of the untransferred toner image by the fur brush for electrostatically removing the toner on the intermediary transfer belt is improved has also been known (JP-A 2008-122625). In the case of the structure described in JP-A 2008-122625, the patch transferred on the intermediary transfer belt is sent to the fur brush, without being deposited on a secondary transfer roller, by separation between the secondary transfer roller and the belt at the secondary transfer portion.

In the case where the patch is formed between the images as described above, as shown in FIG. 20, there is a need to arrange the patches different in density in a main scan direction which is an axial direction of the photosensitive drum 1. Further, in order to detect the density of the plurality of patches arranged in the main scan direction, sensors are required correspondingly to the number of the patches. Here, the number of the sensors which can be provided is limited and therefore the number of the patches which can be formed between the images is also limited. For this reason, the control of the density and the gradation by the patch is not readily effected with high accuracy.

On the other hand, it would be considered that the patches are arranged and formed in sub-scan direction perpendicular to the main scan direction at a position in which the patches are adjacent to the normal image with respect to the main scan direction. When the plurality of patches are arranged in the sub-scan direction, the density of the patches can be detected by a single sensor and therefore the number of the patches can be easily increased, so that the control of the density and the gradation can be effected with high accuracy.

However, in the case where the patches are formed at the adjacent position to the normal image, the reverse bias application at the patch portion as described in JP-A 2008-129472 cannot be performed. For this reason, as shown in (*a*) of FIG. 21, the patch β is also transferred together with the normal image α onto an intermediary transfer belt (intermediary transfer member) 6. However, at the secondary transfer portion where the image is transferred from the intermediary transfer belt 6 onto a recording material 7, the normal image α is transferred onto the recording material 7 and on the other hand, the patch β is transferred onto a secondary transfer bias 9. Here, at the secondary transfer portion, a bias to which a paper-shaving voltage in view of impedance of the recording material 7 is added is to be applied but the patch β located at a position apart from the recording material 7 is, as shown in (*b*) of FIG. 21, subjected to electric discharge at a degree more than that for the normal image by the paper-sharing voltage. As a result, e.g., there is a case where a part of the patch β carried by the negative-polarity voltage is discharged to about 0 volts or a positive polarity.

As the structure in which the toner deposited on the secondary transfer roller 9 is electrostatically removed, there is a structure in which an electrostatic cleaning means such as the fur brush is disposed. However, as described above, a part of the patch β which is discharged to about 0 volts or is positively charged is less liable to be removed. In the case where the toner remains on the secondary transfer roller 9 without being removed by the electrostatic cleaning means, the back surface of a subsequent recording material 7 to be subjected to the image formation after the recording material 7 passes through the secondary transfer portion is contaminated with the residual toner.

SUMMARY OF THE INVENTION

A principal object of the present invention is to provide an image forming apparatus capable of suppressing contamination of a transfer portion even when cleaning of the transfer portion at which a toner image is transferred from an intermediary transfer member onto a recording material is electrostatically effected.

According to an aspect of the present invention, there is provided an image forming apparatus comprising:

an image bearing member;

image forming means for forming a toner image on the image bearing member, the image forming means being capable of forming an image to be formed on a recording material and forming a control image for controlling an image density at a position adjacent to the image to be formed on the recording material;

an intermediary transfer member rotatable while carrying the toner image transferred from the image bearing member;

a transfer member for forming a transfer portion where the toner image is to be transferred from the intermediary transfer member onto the recording material;

electrostatic cleaning means for electrostatically removing the toner deposited on the transfer member;

density detecting means, provided upstream of the transfer member with respect to a rotational direction of the intermediary transfer member, for detecting a density of the control image transferred on the intermediary transfer member;

adjusting means for adjusting an image forming condition of the image forming means depending on an output of the density detecting means; and charge amount changing means for adjusting a charge amount of the control image transferred onto the intermediary transfer member.

These and other objects, features and advantages of the present invention will become more apparent upon a consideration of the following description of the preferred embodiments of the present invention taken in conjunction with the accompanying drawings.

Figure 5:
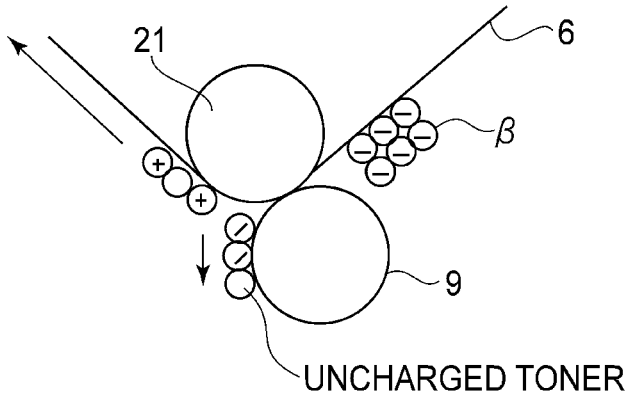
Figure 5:
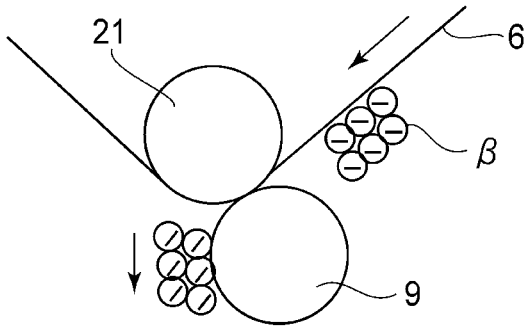

Parts (*a*) and (*b*) of FIG. 5 are schematic views for illustrating a charge polarity relationship of toners at a secondary transfer position, in which (*a*) shows the case where the patch is not charged and (*b*) shows the case where the patch is charged.

Figure 6:
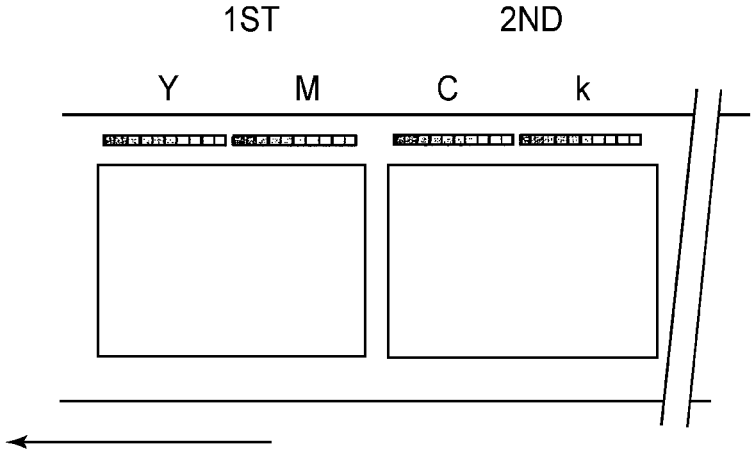

FIG. 6 is a schematic view for illustrating a positional relationship between the normal image and the patch in Embodiment 1.

Figure 7:
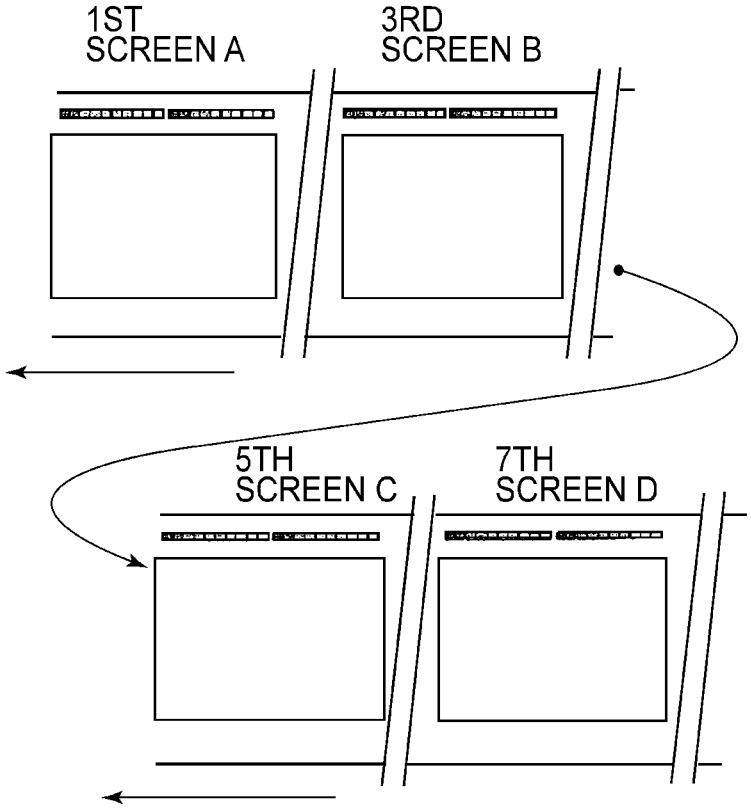

FIG. 7 is a schematic view for illustrating the type of a patch screen in First Embodiment.

Figure 8:
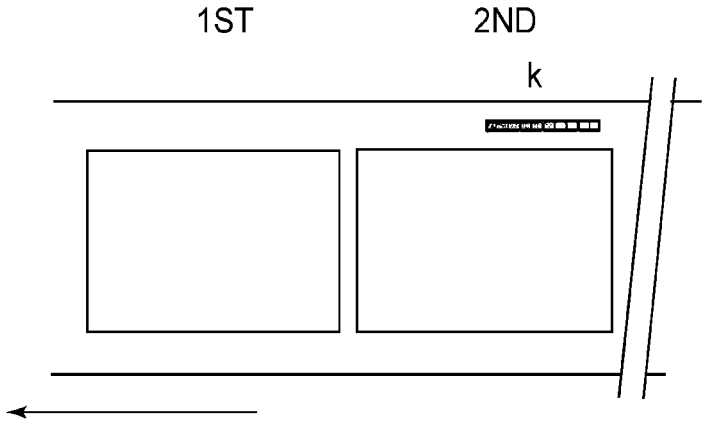

FIG. 8 is a schematic view for illustrating the positional relationship between the normal image and the patch during black (monochromatic) image formation.

Figure 9:
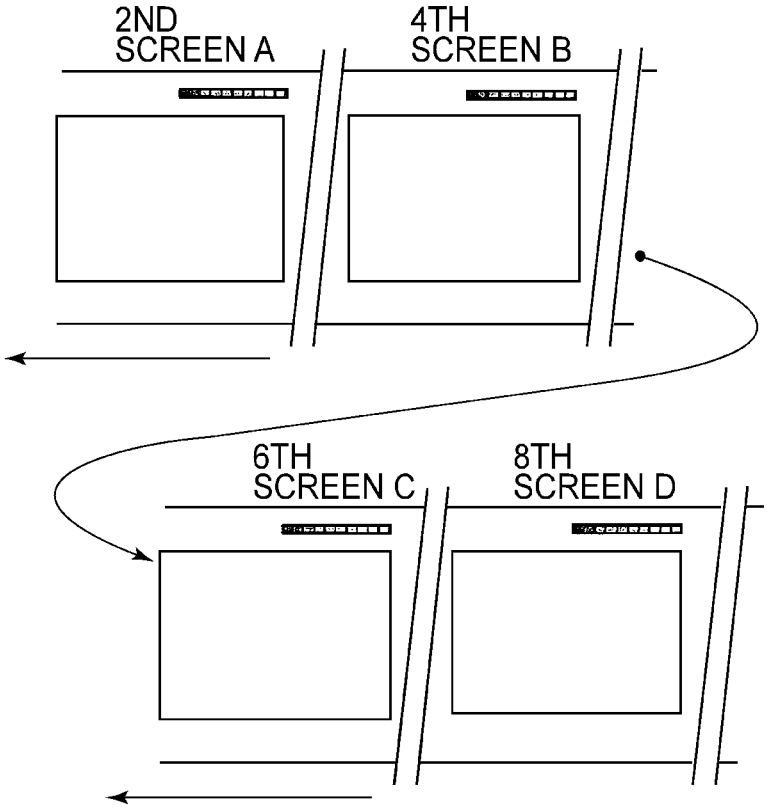

FIG. 9 is a schematic view for illustrating the type of the patch screen during the black image formation.

Figures 10, 11:
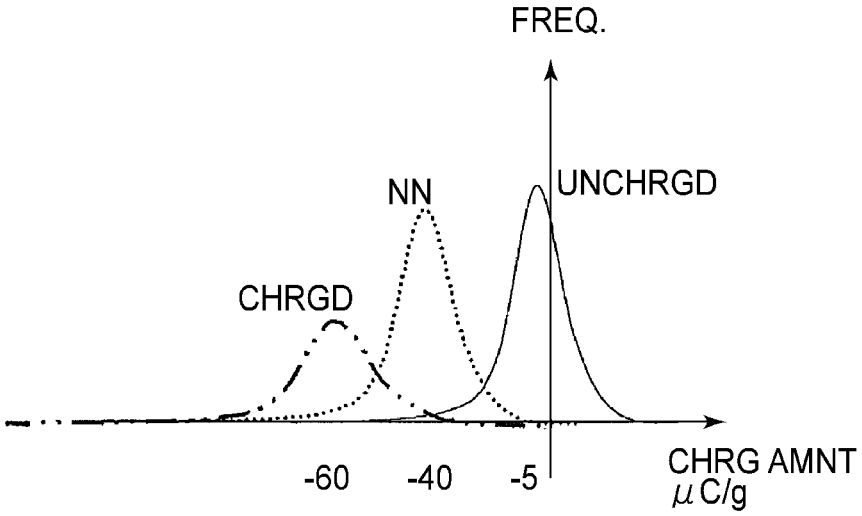

FIG. 10 is a graph showing a distribution of a toner charge amount when the toner is charged and uncharged.

FIG. 11 is a table showing a relationship among a basis weight of a recording material, a secondary transfer voltage and a charger current.

Figure 12:
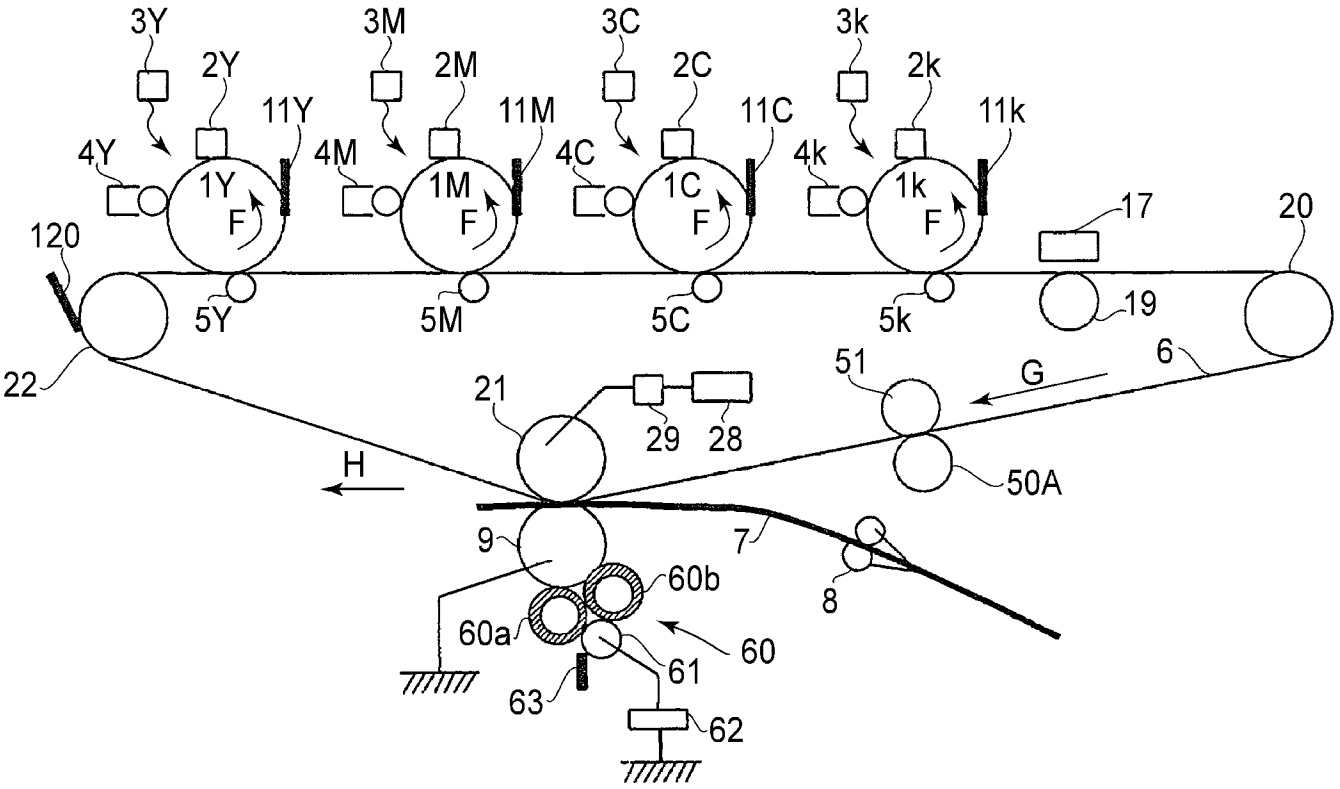

FIG. 12 is a schematic structural view of an image forming apparatus in Second Embodiment of the present invention.

Figure 13:
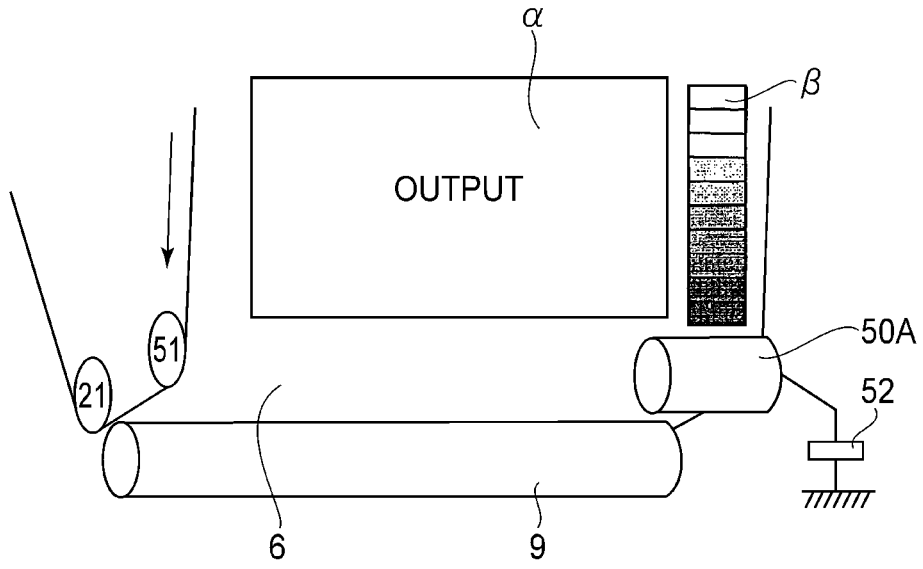

FIG. 13 is a schematic view for illustrating positional relationship among the charging device, the normal image and the patch.

Figure 14:
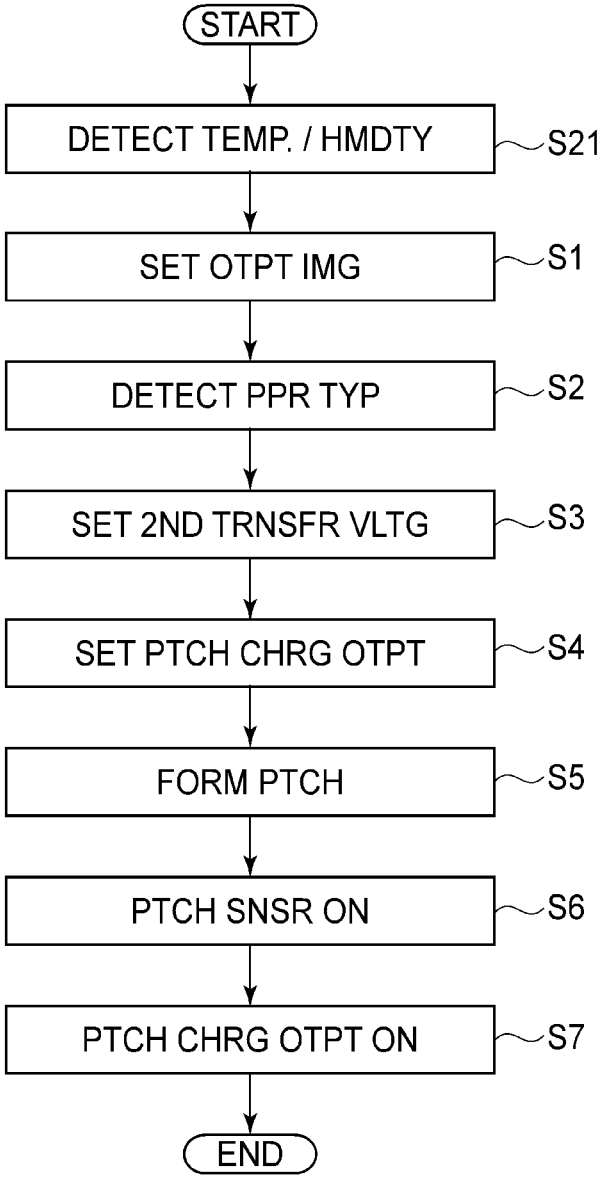

FIG. 14 is a flow chart in Third Embodiment.

Figures 15, 16, 17:
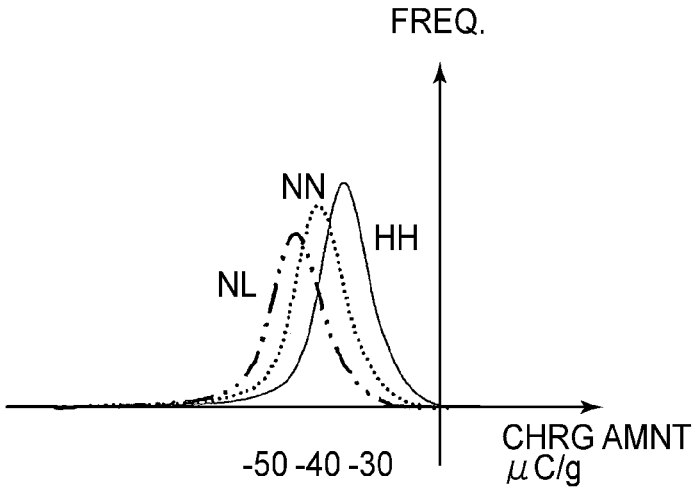

FIG. 15 is a graph showing a distribution of the toner charge amount in different environments.

FIG. 16 is a graph showing a relationship between input signal of the patch and the charger current in different environments.

FIG. 17 is a graph for illustrating the effect of the present invention.

Figure 18:
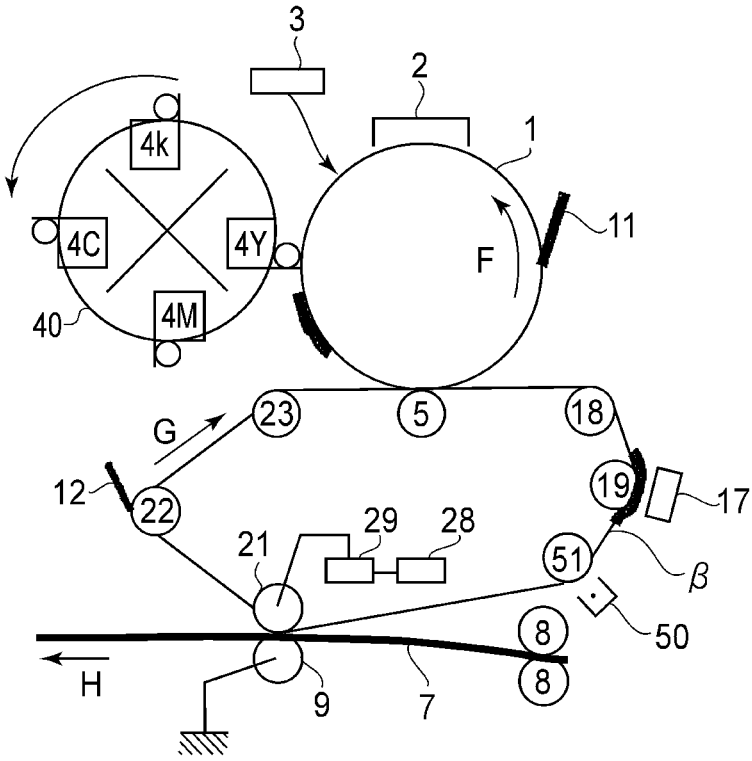

FIG. 18 is a schematic structural view of another example of the image forming apparatus.

Figure 19:
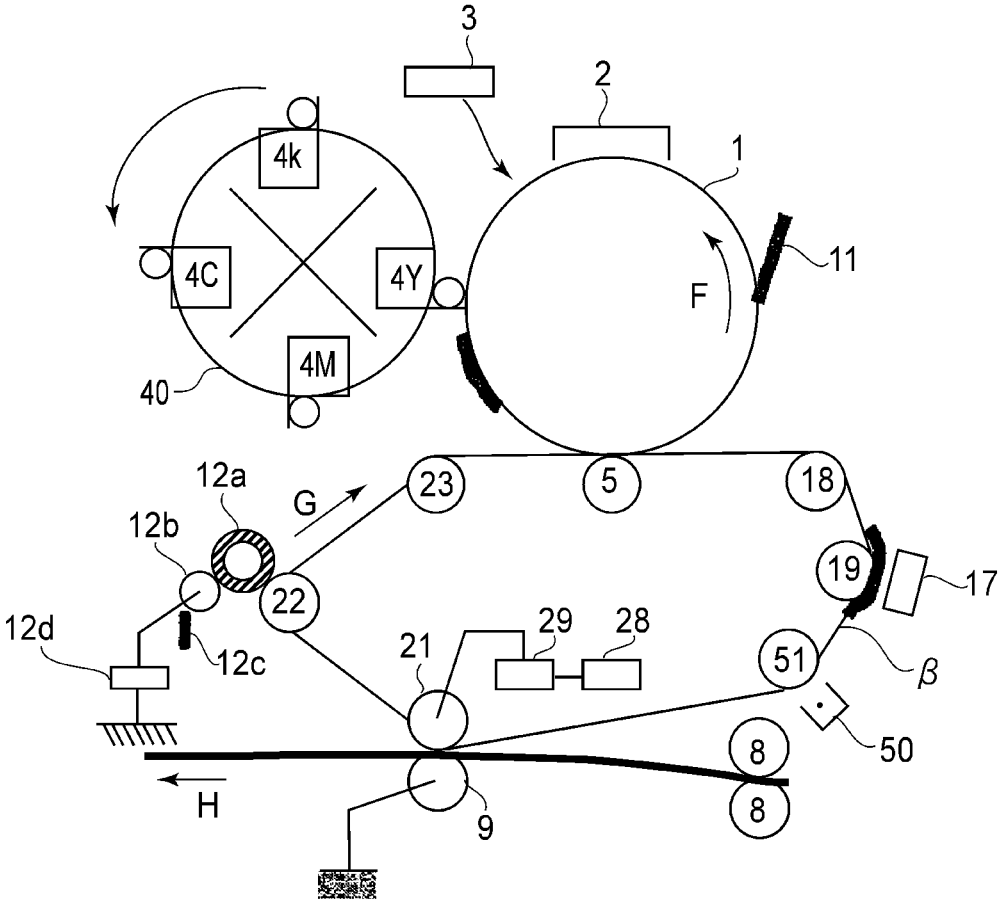

FIG. 19 is a schematic structural view of a further example of the image forming apparatus.

Figure 20:
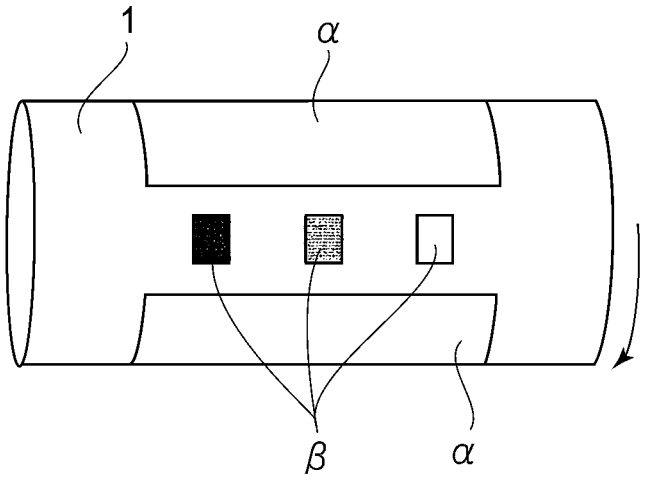
FIG.20 (PRIOR ART)

FIG. 20 is a perspective view of a photosensitive drum in the case where the patches are formed at a sheet interval.

Figure 21:
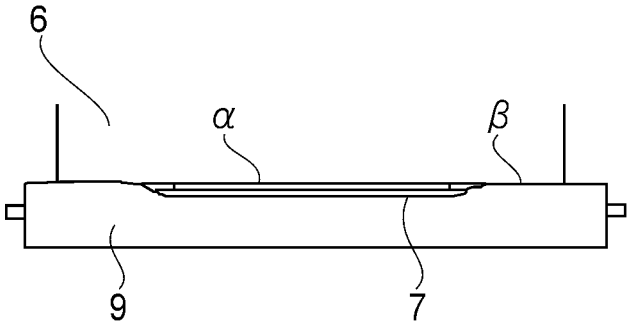
FIG.21 (PRIOR ART)
Figure 21:
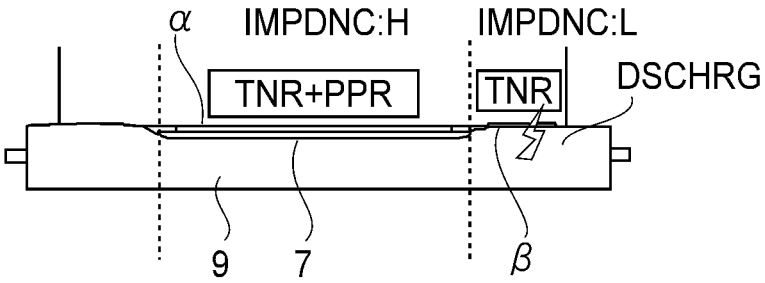
FIG.21 (PRIOR ART)

Parts (*a*) and (*b*) of FIG. 21 are schematic views, for illustrating a problem in the case where the patches are formed at a side of the normal image, as seen from a side portion of a secondary transfer position.

Figure 22:
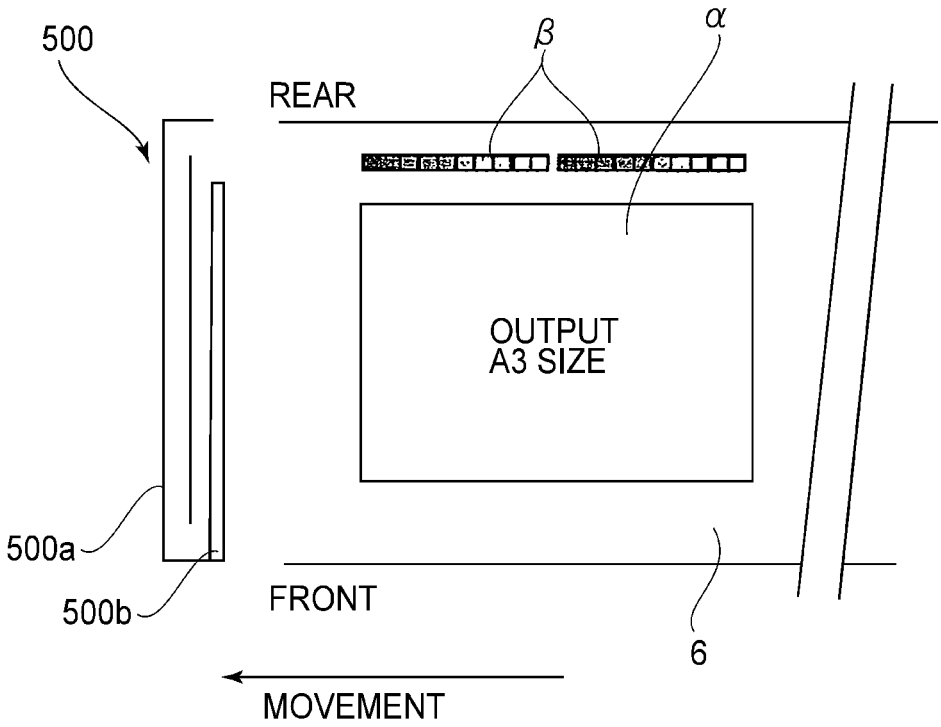

FIG. 22 is a schematic view showing the positional relationship among the charging device, the normal image and the patch.

Figure 23:
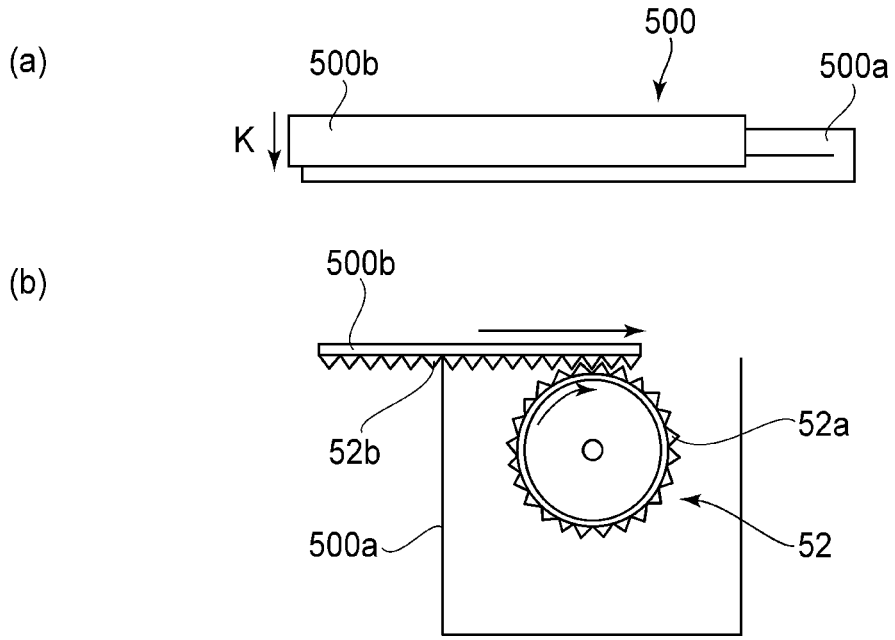

Parts (*a*) and (*b*) of FIG. 23 are schematic views for illustrating a structure of a shutter of the charging device, in which (*a*) is a schematic view as seen from the shutter side and (*b*) is a schematic view as seen from a side portion.

Figure 24:
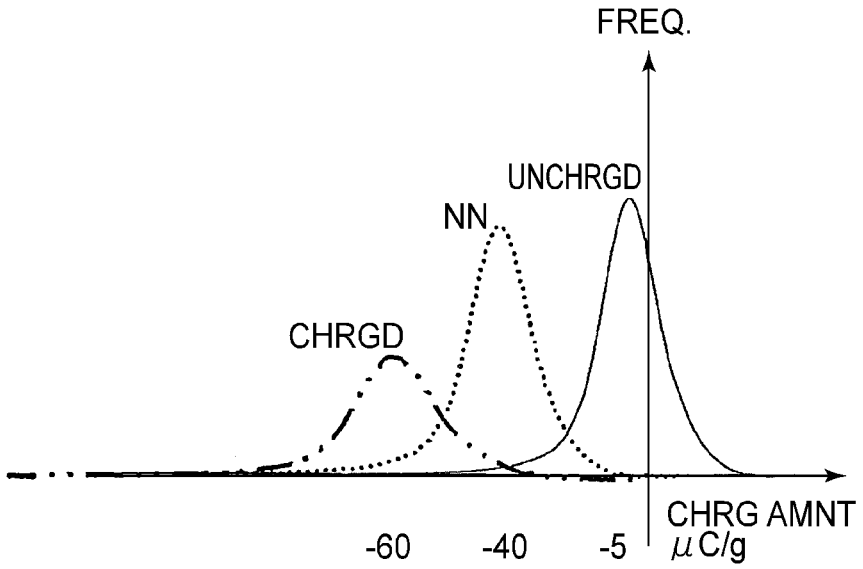

FIG. 24 is a graph showing the distribution of the toner charge amount when the toner is charged and uncharged.

Figure 25:
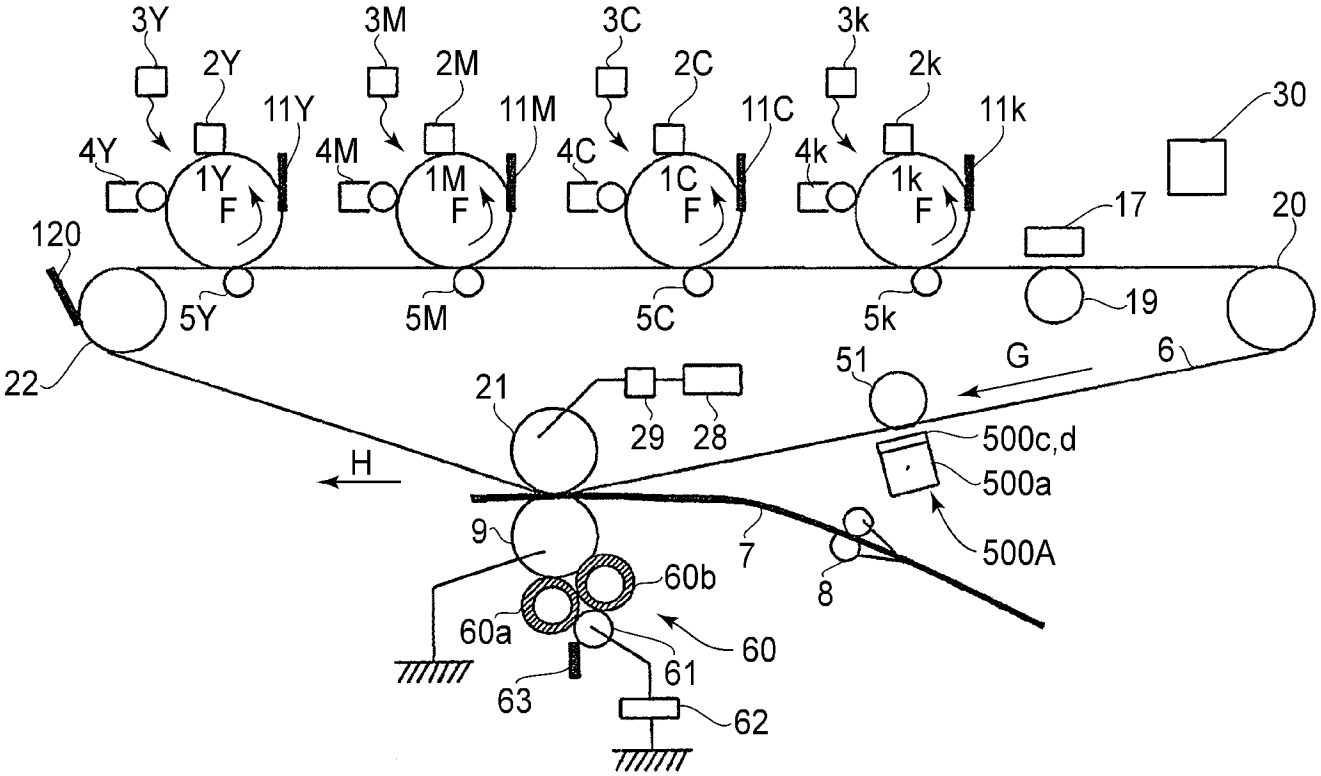

FIG. 25 is a schematic structural view of an image forming apparatus in Fifth Embodiment of the present invention.

FIG. 26 is a table showing an open/close state of the shutter of the charging device.

Figure 27:
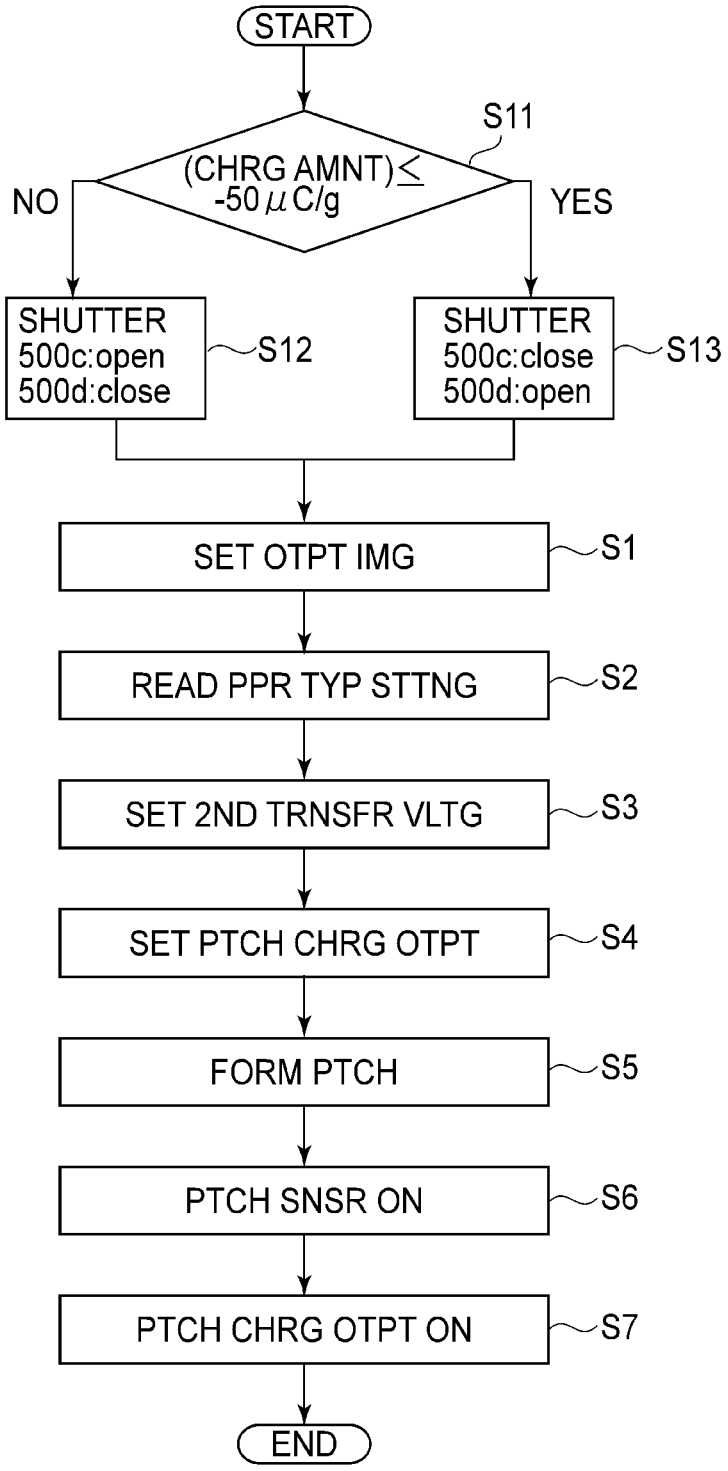

FIG. 27 is a flow chart of control with respect to a recording material of sizes up to a large size.

Figure 28:
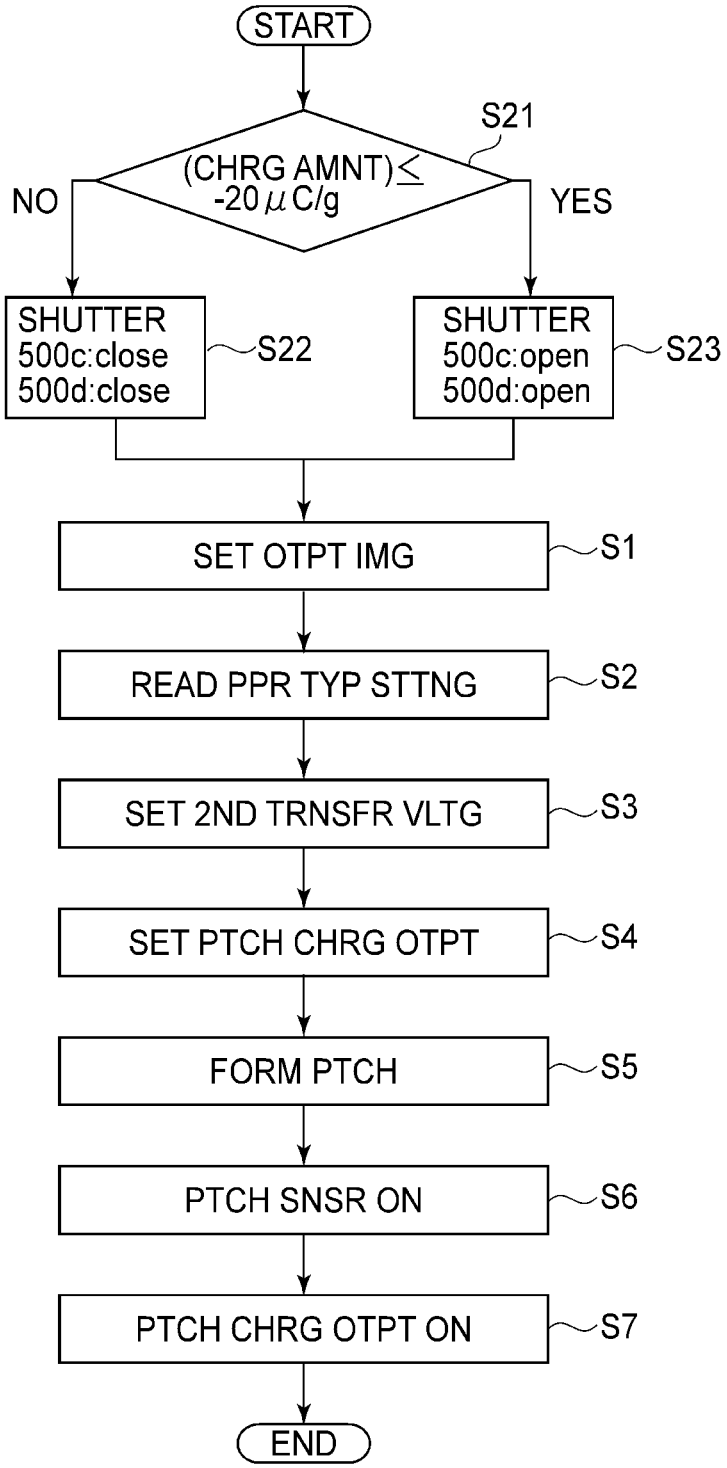

FIG. 28 is a flow chart of control with respect to a recording material of an overlarge size.

Figure 29:
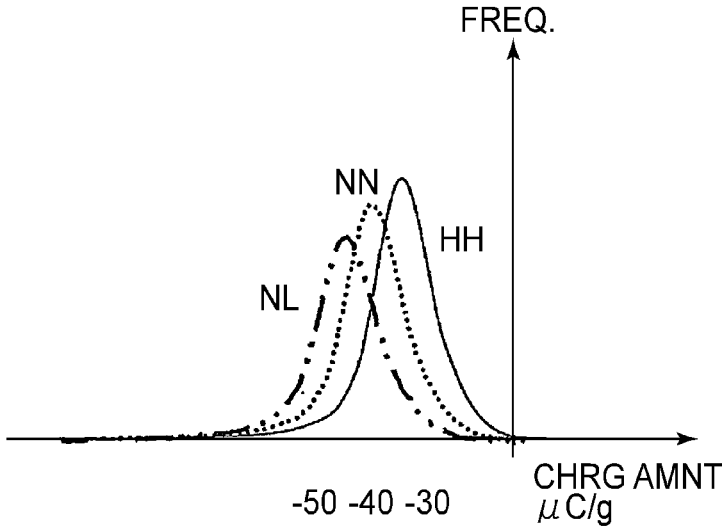

FIG. 29 is a graph showing the distribution of the toner charge amount indifferent environments.

Figure 30:
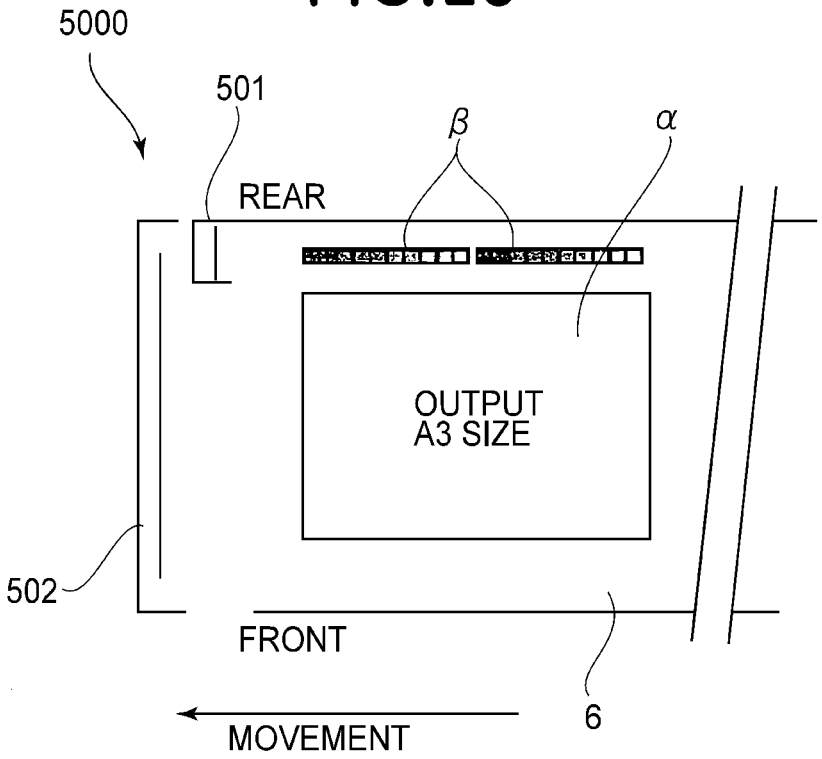

FIG. 30 is a schematic view for illustrating the positional relationship among the charging device, the normal image and the patch.

DESCRIPTION OF THE PREFERRED EMBODIMENTS

First Embodiment

First Embodiment of the present invention will be described with reference to FIG. 1 to FIG. 11. First, with reference to FIG. 1, an image forming apparatus in this embodiment will be described. The image forming apparatus in this embodiment has a constitution of a so-called tandem type in which a plurality of image forming stations for different colors are juxtaposed in a rotational direction of an intermediary transfer member. Incidentally, in the following description, to reference numerals or symbols for constituent elements for yellow, magenta, cyan and black, suffixes Y, M, C and k are added, respectively. However, with respect to the same constitution, these suffixes are omitted in some cases.

Image Forming Apparatus

Figure 1:
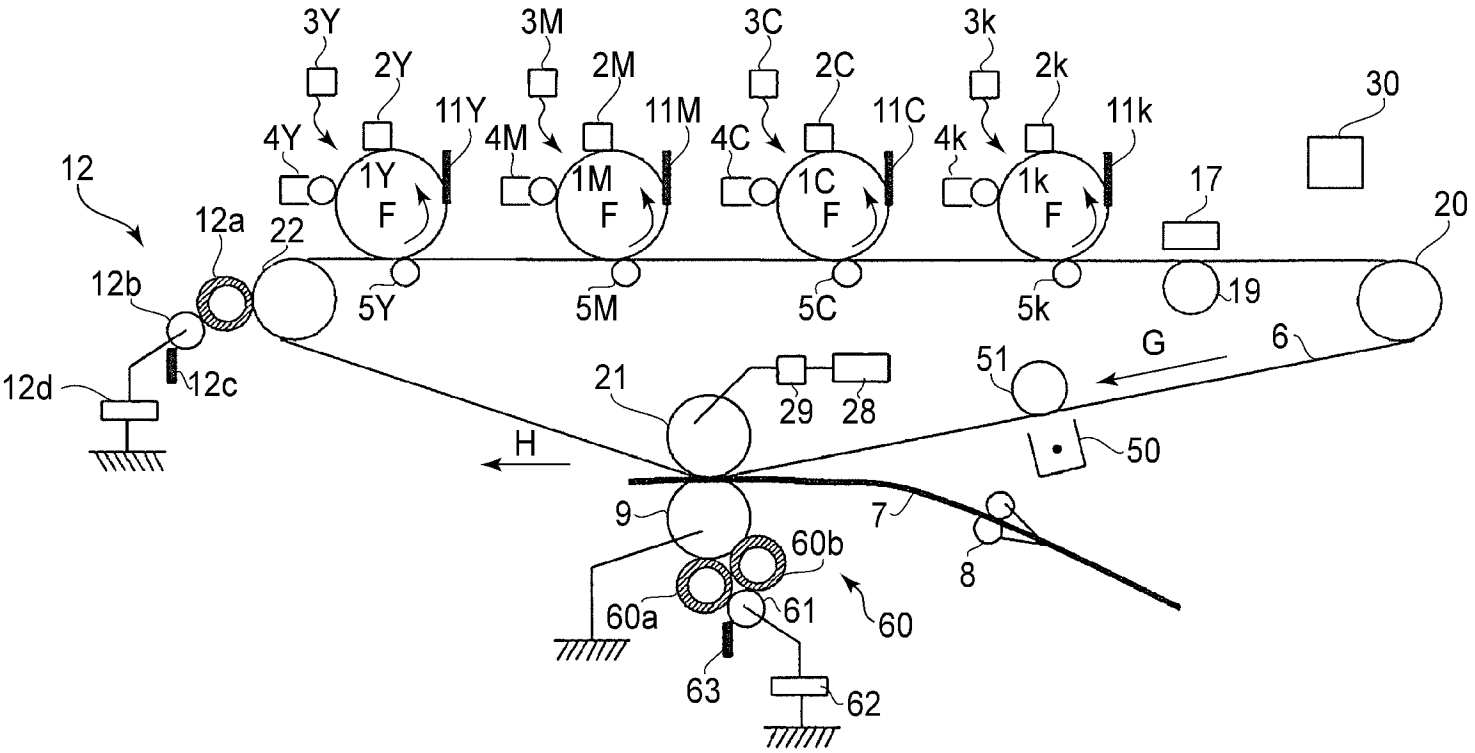
FIG. 1 is a schematic structural view of an image forming apparatus in First Embodiment according to the present invention.

In FIG. 1, around photosensitive drums (photosensitive members, image bearing members) 1Y, 1M, 1C and 1*k*, members including charging devices 2Y, 2M, 2C and 2*k*, exposure devices 3Y, 3M, 3C and 3*k*, developing devices 4Y, 4M, 4C and 4*k*, an intermediary transfer belt (intermediary transfer member) 6 and the like are disposed. The photosensitive drum 1 is rotationally driven in an arrow F direction at a predetermined peripheral speed (process speed). The charging device 2 electrically charges the peripheral surface of the photosensitive drum 1 to a predetermined polarity and a predetermined potential (primary charging). A laser beam scanner as the exposure device 3 outputs laser light which is ON/OFF-modulated correspondingly to image information inputted from an unshown external device such as an image scanner or a computer, so that the charged surface of the photosensitive drum 1 is subjected to scanning exposure. By this scanning exposure, an electrostatic latent image depending on objective image information is formed on the surface of the photosensitive drum 1.

The developing devices 4Y, 4M, 4C and 4*k* incorporates therein color component toners of yellow (Y), magenta (M), cyan (C) and black (K), respectively. Further, on the basis of the image information, the developing device 4 to be used is selected and develops the electrostatic latent image with the developer (toner) on the surface of the photosensitive drum 1, so that the electrostatic latent image is visualized as the toner image. In this embodiment, a normal triboelectric chargeability (normal charge polarity) is negative. In this embodiment, as described above, a reverse developing method in which the toner is deposited on the exposed portion of the electrostatic latent image to develop the electrostatic latent image. The charging device, the exposure device and the develop device constitute an image forming means.

The intermediary transfer belt 6 is an endless belt and is disposed in contact with the surface of the photosensitive drum 1, and is stretched around a plurality of a plurality of stretching rollers 20, 21 and 22. The intermediary transfer belt 6 is rotationally moved in an arrow G direction at a speed of, e.g., 300 mm/sec. In this embodiment, the stretching roller 20 is a tension roller configured to control the tension of the intermediary transfer belt 6 at a constant level, the stretching roller 22 is a driving roller for driving the intermediary transfer belt 6, and the stretching roller 21 is an opposite roller for secondary transfer. Further, at the primary transfer position, each of primary transfer rollers 5Y, 5M, 5C and 5*k* is disposed opposed to the associated photosensitive drum 1 while sandwiching the intermediary transfer belt 6 between itself and the photosensitive drum 1.

In this embodiment, as the intermediary transfer belt 6, the endless belt prepared by containing carbon black as an antistatic agent in an appropriate amount in various resin or rubber materials such as polyimide and polycarbonate. The intermediary transfer belt 6 has a volume resistivity of, e.g., $1\times10^{9}$-$1\times10^{14}$ ohm·cm and a thickness of, e.g., 0.07-0.5 mm.

The respective unfixed color toner images formed on the photosensitive drums 1 are successively primary-transferred electrostatically onto the intermediary transfer belt 6 by applying a primary transfer bias of a positive polarity opposite to the (negative) toner charge polarity from a constant voltage source or a constant current source to the primary transfer rollers 5. Thus, on the intermediary transfer belt 6, a full-color image obtained by superposing the unfixed four color toner images is obtained. The intermediary transfer belt 6 is rotated while carrying the toner images transferred from the photosensitive drums 1. Every one rotation of the photosensitive drum 1 after the primary transfer, the surface of the photosensitive drum 1 is subjected to cleaning of a transfer residual toner by a cleaning device 11 and then repeatedly enters a subsequent image forming process.

Further, at the secondary transfer position of the intermediary transfer belt 6 facing a conveying path of the recording material 7, a secondary transfer roller 9 (transfer position) is press-contacted to the intermediary transfer belt 6 at a toner image-carrying surface side. Further, inside the intermediary transfer belt 6 at the secondary transfer position, the opposite roller 21 which constitutes an opposite electrode to the secondary transfer roller 9 and to which a bias is to be applied is disposed. When the toner image on the intermediary transfer belt 6 is transferred onto the recording material 7, to the opposite roller 21, the bias of an identical polarity to the toner charge polarity is applied from a transfer bias applying means 28. For example, the bias voltage of −1000 to −3000 V is applied, so that a current of −10 to −50 μA flows. The transfer voltage at this time is detected by a high transfer voltage detecting means 29. Further, at a downstream side of the secondary transfer position, a cleaning device (belt cleaner) 12 for removing the toner remaining on the intermediary transfer belt 6 after the secondary transfer is provided.

In this embodiment, each of the primary transfer roller 5 and the secondary transfer roller 9 is prepared by forming an electroconductive layer on an outer peripheral surface of a core metal of, e.g., 8-12 mm in outer diameter, so as to provide an outer diameter of 16-30 mm. The electroconductive layer is prepared by mixing an ion conductive substance into a base material using a polymeric elastomer or polymeric foam material of hydrin rubber, EPDM or the like, and is adjusted at a medium resistance level of 1 MΩ to 100 MΩ as electroconductivity. Further, as a surface layer of the secondary transfer roller 9, a resin coating layer formed of urethane or nylon in the thickness of 2-10 μm is used. The hardness of the whole transfer roller is 25-40 degrees in terms of Asker C hardness. A load of 0.6-1.5 kgf (5.88-14.7 N) is exerted on the photosensitive drum 1, and a load of 1.5-5 kgf (14.7 N-49.03 N) is exerted on the opposite roller 21 for the secondary transfer.

Further, in an unshown sheet feeding cassette, sheets of the recording material 7 are accommodated. On the basis of a sheet feeding start signal, an unshown sheet feeding roller is driven, so that the recording material 7 in the sheet feeding cassette is fed one by one and then is conveyed in an arrow H direction by a registration roller 8. The conveyance of the recording material 7 is controlled by the registration roller 8 so as to be synchronized with timing when a leading end of the toner image on the intermediary transfer belt 6 reaches the secondary transfer position.

The recording material 7 introduced into the secondary transfer position is nip-conveyance at the secondary transfer position and at that time, a constant voltage bias (transfer bias) controlled in a predetermined manner is applied from a secondary transfer bias applying means 28 to the opposite roller 21 of the secondary transfer roller 9. The transfer bias of the identical polarity to the toner charge polarity is applied to the opposite roller 21, so that the four color-based full-color images (toner images) superposed on the intermediary transfer belt 6 are collectively transferred onto the recording material at the transfer position to form an unfixed full-color toner image on the recording material.

The recording material 7 on which the toner images are transferred at the transfer position is separated from the intermediary transfer belt 6 and then is conveyed and introduced into an unshown fixing device, so that the recording material 7 is subjected to a fixing step of the toner image under heat and pressure. On the other hand, the intermediary transfer belt 6 after the transfer separation is subjected to cleaning by a cleaning device 12 to remove transfer residual toner, thus repeatedly entering the image forming step. The cleaning device 12 electrostatically removes the toner on the intermediary transfer belt 6.

The cleaning device 12 includes a fur brush 12*a* and a metal roller 12*d*. To the metal roller 12*b*, a power source 12*d* is connected. The stretching roller 22 which is grounded is disposed at a position in which the roller 22 opposes the cleaning device 12 via the intermediary transfer belt 6 in contact with the intermediary transfer belt 6. Further, the fur brush 12*a* is rotated counterdirectionally to the intermediary transfer belt 6. Then, to the power source 12*d*, a constant voltage-controlled high voltage (cleaning bias) is applied, so that the residual toner deposited on the surface of the intermediary transfer belt 6 is attracted by the fur brush 12*a* through an electrostatic force to be collected and removed. The toner collected by the fur brush 12*a* is collected by the metal roller 12 and is removed by a blade 12*c*.

The secondary transfer roller 9 is provided with a secondary transfer portion cleaning device (electrostatic cleaning means) 60 for electrostatically removing the toner deposited on the secondary transfer roller 9. The secondary transfer portion cleaning device 60 includes fur brushes 60*a* and 60*b* and a metal roller 61. To the metal roller 61, a power source 62 is connected. The secondary transfer roller 9 is grounded. The fur brushes 60*a* and 60*b* are rotated counterdirectionally to the secondary transfer roller 9. Then, to the power source 62, a constant voltage-controlled high voltage (cleaning bias) is applied, so that the residual toner deposited on the surface of the secondary transfer roller 9 is attracted by the fur brushes 60*a* and 60*b* through the electrostatic force to be collected and removed. The toner collected by the fur brushes 60*a* and 60*b* is collected by the metal roller 61 and is removed by a blade 63. In this embodiment, the two fur brushes 60*a* and 60*b* are provided, so that a contact area between the secondary transfer roller 9 and the fur brushes is increased and thus a collection efficiency is improved. It is also possible to use a single fur brush.

Figure 2:
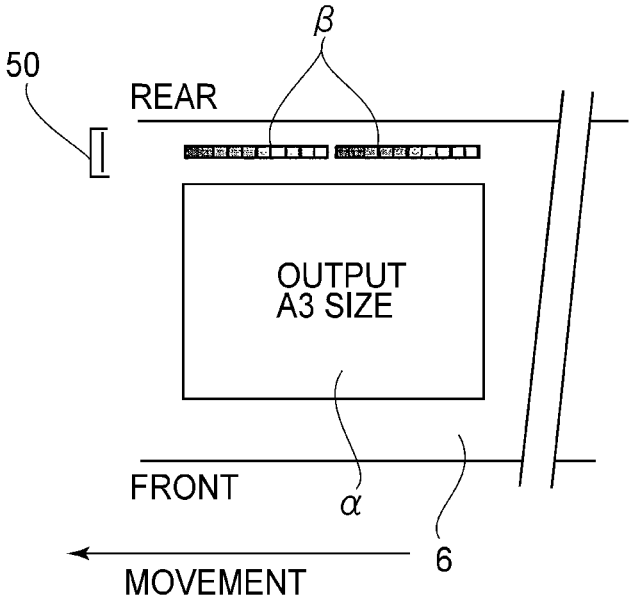
FIG. 2 is a schematic view showing a positional relationship among a charging device, a normal image and patches.

Further, in this embodiment, as shown in FIG. 2, the normal image α based on the image data and the patch β which is the control image are formed, and the patch βB is detected, so that the density and gradation of the output image (normal image) are controlled. The patch β is formed at a position spaced from the normal image α with respect to the direction (main scan direction) perpendicular to the rotational direction (sub-scan direction) of the intermediary transfer belt 6. For example, as shown in FIG. 2, the patch β is formed at the position spaced from an area, in which the output image on an A3-sized sheet is to be outputted, with respect to the main scan direction. Further, the patch β is constituted by a plurality of images different in density and gradation arranged in the sub-scan direction.

Density Detecting Portion

In this embodiment, in order to detect such a patch β, a single patch sensor (density detecting means or portion) 17 is provided, upstream of the secondary transfer roller 9 with respect to the rotational direction of the intermediary transfer belt 6, at a position in which the patch sensor 17 opposes the intermediary transfer belt 6. Further, an opposite roller 19 is disposed, in contact with the intermediary transfer belt 6, at a position in which the roller 19 opposes the patch sensor 17 via the intermediary transfer belt 6. These positions of the patch sensor 17 and the opposite roller 19 are downstream of a downstreammost image forming station and are upstream of the secondary transfer position with respect to the rotational direction of the intermediary transfer belt 6. In FIG. 1, the patch sensor 17 and the opposite roller 19 are disposed between the block photosensitive drum 1*k* and the stretching roller 20.

Further, the positions of the patch sensor 17 and the opposite roller 19 with respect to the mains can direction are such that the positions opposite to the position in which the patch β is formed. That is, the patch sensor 17 is disposed at the position spaced from the area, in which the normal image α is formed, with respect to the main scan direction. In FIG. 2, the patch β is disposed at the rear side with respect to a widthwise direction (main scan direction) of the intermediary transfer belt 6 and therefore the patch sensor 17 is also disposed at the rear side. Incidentally, in the case where the image forming apparatus is mounted, a side where a user operates the image forming apparatus is referred to as a front side and its opposite side is referred to as the rear side.

Charge Amount Changing Portion

In this embodiment, between the secondary transfer position and the patch sensor 17, a charging device 50 (charge amount changing means or portion) for changing the charge amount of the patch β transferred on the intermediary transfer belt 6 is disposed. That is, with respect to the rotational direction, the charging device 50 is disposed, upstream of the secondary transfer roller 9 and downstream of the patch sensor 17, so as to oppose a portion where the patch β is formed on the outer peripheral surface (image transferred surface) of the intermediary transfer belt 6. Further, an opposite roller 51 is disposed, in contact with the intermediary transfer belt 6, at a position in which the roller 51 oppose the charging device 50 via the intermediary transfer belt 6.

Such a charging device 50 is a corona charger and is disposed at the position in which the charging device 50 opposes the patch β but does not oppose the normal image α. In this embodiment, by the charging device 50 having such a constitution, the patch β is charged without charging the normal image α. That is, when the charging device 50 is turned on, the patch β is charged, so that only the charge amount of the patch β can be increased. Further, when the charging device 50 is turned off, the patch β can be prevented from being charged. Further, the charge amount of the patch β can be lowered by applying an opposite voltage to the charging device 50. Thus, the charge amount of the patch β can be changed by on/off control of the charging device 50 or by changing the applied voltage.

Controller

Figure 3:
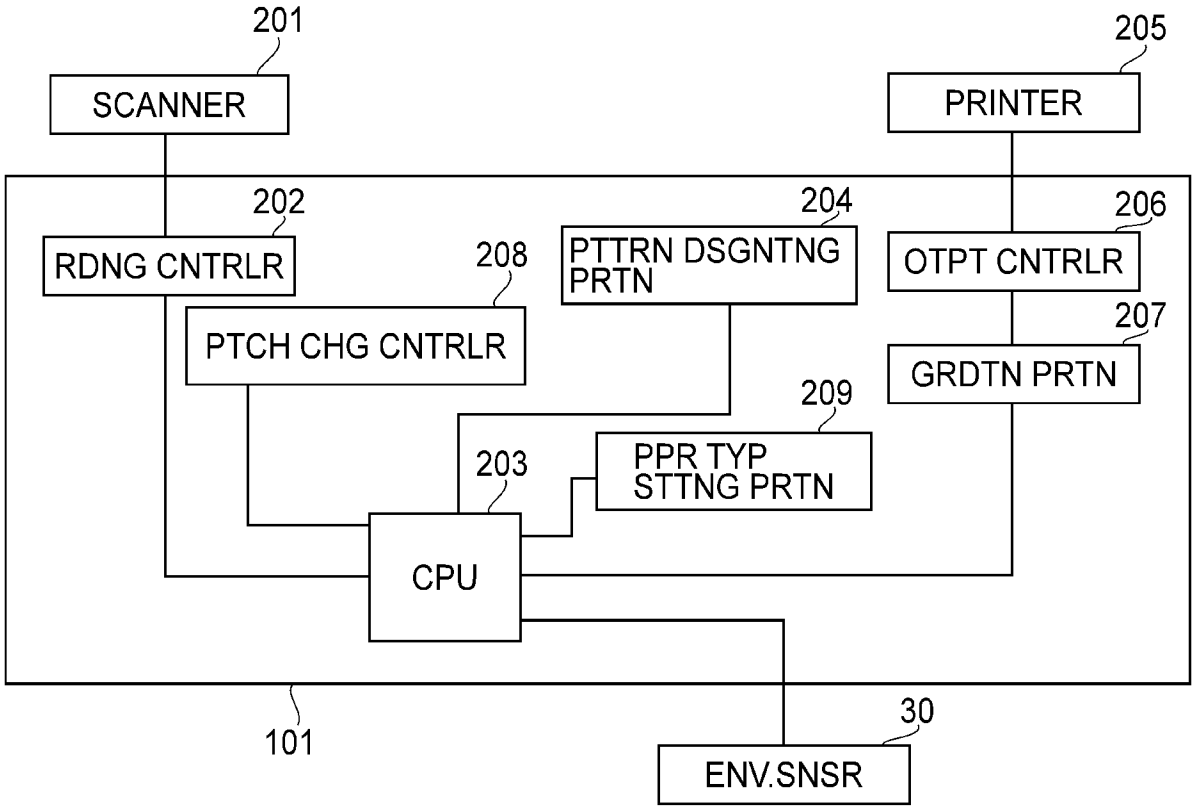
FIG. 3 is a block diagram of a controller of the image forming apparatus in First Embodiment.

Next, control in this embodiment will be described also with reference to FIGS. 3 and 4. As shown in FIG. 3, a controller (control means) 101 controls a printer 205 as an image forming means on the basis of data (not shown) read by a scanner 201 as an image reading means or sent from an external device. Further, the controller 101 controls the charging device 50 so that a removing efficiency of the patch β, transferred on the secondary transfer roller 9, by the secondary transfer cleaning device 60 can be improved. For this purpose, the controller 101 includes a reading controller 202, a CPU 203, a pattern designating portion 204, an output controller 206, a gradation correcting portion 207, a patch charge controller 208 and a paper type setting portion (sheet type setting means) 209. The reading portion 202 controls reading of the image data by the scanner 201. The patch charge controller 208 controls the charging device 50. The pattern designating portion sets the output image. The output controller 206 sets the secondary transfer voltage and the like.

The gradation correcting portion 207 corrects the gradation (level) of the output image. The paper type setting portion 209 sets the paper type (e.g., plain paper, thick paper, coated paper, etc.) inputted by the user by an unshown inputting means. The CPU 203 controls these portions.

Incidentally, setting of the paper type can also be performed by providing a sensor (paper type detecting means) for detecting the paper type at any portion of a conveying path of the recording material 7. Such a sensor detects the paper type on the basis of information on reflection of ultrasonic wave applied to the recording material.

An example of the control by the controller 101 will be described along a flow chart shown in FIG. 4. First, an original is read by driving the scanner 201 by the reading controller 202, so that the output image is set by the pattern designating portion 204 (S1). Next, reading of the paper type setting is effected by the paper type setting portion 209 (S2). Then, the secondary transfer voltage depending on the paper type is set by the output controller 206 (S3), and a patch charging output depending on the secondary transfer voltage is set by the patch charge controller 208 (S4). Incidentally, the secondary transfer voltage can also be set by taking a detection result of an environment sensor 30 described later into consideration. Thereafter, the pattern designating portion 204 provides an instruction so that the output image (normal image &a) and the patch β located at the side of the output image are formed on the intermediary transfer belt 6, with the result that the patch β is formed at the side of the control image (S5). Then, the patch sensor 17 is turned on, so that gradation correction is made on real time by the gradation controller 207 (S6). The patch which reaches the charging device 50 is charged by performing the patch charging output by the patch charge controller 208 (S7). The patch charging is continued until a final patch on the last sheet designated for output passes through the charging device 50.

As in this embodiment, when the patch β is formed adjacently to the normal image α, the plurality of patches can be provided in line in the sub-scan direction without increasing the number of the patch sensor 17. For this reason, the control of the density and gradation of the output image can be effected inexpensively with high accuracy. Further, the charge amount of the patch β is changed by the charging device 50 and even when the patch β is formed adjacently to the normal image α, the charge amount of the patch β can be adjusted at a proper level.

Specifically, in the case where the patch β is formed at the position spaced from the recording material 7, the patch β is transferred onto the secondary transfer roller 9 at the secondary transfer position. At this time, a voltage larger than that applied to the normal image α transferred onto the recording material 7 is applied to the patch β. For this reason, when the charge amount of the patch β is small, the charge amount can be become about zero during the voltage application, so that the electrostatic cleaning of the patch β on the secondary transfer roller 9 cannot be sufficiently performed by the secondary transfer portion cleaning device 60. In this embodiment, as described above, the charge amount of the patch β is increased by the charging device 50, so that a degree of the decrease in charge amount to about zero can be reduced even when the patch β is transferred onto the secondary transfer roller 9.

That is, as shown in (*a*) of FIG. 5, in the case where the patch β is not charged, the toner with no charge amount is generated at the secondary transfer position and cannot be electrostatically removed. On the other hand, as shown in (*b*) of FIG. 5, when the patch β is charged to the negative polarity relative to the normal image α at the position upstream of the secondary transfer position, substantially all of the patches β are transferred onto the secondary transfer roller 9 and can be electrostatically removed.

On the other hand, when the charge amount of the normal image α transferred onto the recording material 7 is increased, a transfer efficiency by the secondary transfer bias determined in view of the paper-sharing voltage is lowered since the charge amount is out of a good charge amount range, so that there is a possibility that improper transfer occurs. In this embodiment, it is possible to prevent an increase in charge amount of the normal image α by disposing the charging device 50 at the position in which the charging device 50 opposes the patch β but does not oppose the normal image α. As a result, the normal image α can be properly transferred onto the recording material 7, and the patch β transferred on the secondary transfer roller 9 can be sufficiently removed and thus contamination of the secondary transfer roller 9 can be suppressed. When the contamination of the secondary transfer roller 9 can be suppressed, a degree of an occurrence of back-side (surface) contamination on the recording material 7 to be subjected to subsequent image formation.

In the control described above, the case where the patch β is transferred onto the secondary transfer roller 9 is described. However, depending on the size of the recording material 7, there is a case where the patch β is transferred onto the recording material 7. For this reason, in this embodiment, the paper type setting portion 209 can read not only the paper type but also the size of the recording material 7. Further, the environment sensor (environment detecting means) 30 for detecting a temperature and humidity in the image forming apparatus is provided (FIGS. 1 and 3). As a result, it is also possible to effect the above-described control also by making reference to the environment detected by the environment sensor 30 and the size of the recording material read by the paper type setting portion 209.

Embodiment 1

Next, a specific embodiment of First Embodiment will be described. First, in this embodiment, the rotational movement speed of the intermediary transfer belt 6 is 300 mm/sec and a measurement temperature and humidity environment is normal temperature and normal humidity environment (NN environment) (23° C., 50% RH). FIG. 6 shows constitutions of the output image (normal image α) and the patch β in this embodiment. The output image size in A3 and at the position (side) adjacent to the output image with respect to the main scan direction, the patch β is formed along a longitudinal direction (sub-scan direction). At the side of the output image on a first sheet, patches for Y and M are formed, and at the side of the output image on a second sheet, patches for C and k are formed. An input signal for patch gradation levels is common to the respective colors, and patches with 10 gradation levels of C0*h*, B0*h*, A0*h*, 90*h*, 70*h*, 50*h*, 40*h*, 30*h*, 20*h* and 10*h* from a leading end side with respect to the belt movement direction are formed. These values represent associated ones of 256 gradation levels by hexadecimal notation and represent descending gradation levels in this order.

FIG. 7 shows screen types of the patches. With respect to the first and second sheets, these two sheets are treated as one set for which each color is changed on the same screen. Similarly, third and later sheets are treated. In this embodiment, a screen A for the first sheet is judged as a photographic portion during copying and is a line screen with 200 lines. A screen B for the third sheet is the photographic portion during printing and is judged as the line screen with 160 lines. A screen C for a fifth sheet is judged as a character portion during the printing and is a 260-line dot screen. Further, a screen D for a seventh sheet is judged as the character portion during the copying and is error diffusion.

FIG. 8 shows the constitution of the output image (normal image α) and the patch β when the black (k) image is formed. In this case, the basic constitutions are similar to those in FIG. 6 but the patches for Y, M and C are not formed. That is, the patch for k is formed at the latter half portion for the second sheet. FIG. 9 shows the patch screen types for k (black). The basic constitution is similar to that in FIG. 7 but the patches for Y, M and C are not formed. That is, the patch is formed at the latter half portion for even-numbered sheets.

These patches β formed at the side of the output images are always formed in a default state except for the case of an overlarge size (330.2×487.7 mm) be can be not formed by user selection.

In this embodiment, the patches having the above-described constitutions are transferred onto the secondary transfer roller 9 and are removed by the secondary transfer portion cleaning device 60. Further, in this embodiment, the charging device 50 is the corona charger of 25 mm in width and is constituted so that ion current flowing from the charging device 50 covers the entire patches with respect to the longitudinal direction but does not cover the output image. Further, in this embodiment, the densest patch (input signal C0H) is set to be transferred onto the secondary transfer roller 9. The current passing through a wire of the charging device 50 is −6 μA and a voltage applied to a shield is 0.1 kV. In this embodiment, the patch is not formed at the sheet interval and therefore the charging device 50 is turned on at the leading end of the first sheet and kept in the on state since the sheet interval during continuous sheet passing is short, and is turned off when a large sheet interval is provided, e.g., when potential control of the photosensitive drum 1 is effected.

Further, in the case where the overlarge-sized paper (sheet) is passed, the charging device 50 is turned off since there are two cases including the case where the patch is transferred onto the paper on the premise that the paper is to be cut and the case where the patch is formed at the sheet interval.

FIG. 10 shows a toner charge amount distribution (triboelectric charge distribution). Measurement was made by using a measuring apparatus ("Espart Analyzer EST-3", mfd. by Hosokawa Micron Corp.) (cyan toner, 3000 counts). In the case of the NN environment (23° C., 50% RH), the triboelectric charge distribution on the intermediary transfer belt 6 is indicated by a dotted line in FIG. 10 and a center value is −40 μC/g. This value is the same with respect to the output image and the patch. The triboelectric charge distribution of the patch in the case where the charging device 50 is turned off is indicated by a solid line ("UNCHARGED") in FIG. 10, so that the toner with no charge amount is generated in a large amount. Therefore, in the case where the secondary transfer roller 9 is of an electrostatic cleaning type, the toner with substantially no charge amount deposited on the secondary transfer roller 9 cannot be removed, so that back-side contamination can occur in the case where a subsequent overlarge-sized paper is passed.

A curve indicated by a chain double-dashed line represents the triboelectric charge distribution of the patch in the case where the charging device 50 is turned on. The center value is about −60 μC/g which is larger than that of the output image by about 20 μC/g in terms of an absolute value. In this state, when the patch reaches the secondary transfer roller 9 to which the high transfer voltage is applied, the charge amount of the patch is substantially balanced with the amount of the current, passing through an area other than the paper area, applied to the secondary transfer roller 9. Further, the toner with no charge amount does not occur and therefore all the patches can be transferred onto the secondary transfer roller 9 and can be then removed by the electrostatic cleaning.

Incidentally, in the image forming apparatus in this embodiment, the type of the paper can be designated by the user, and a value of the secondary transfer bias applying means 28 is changed depending on the type (basis weight) of the paper, so that the output of the charging device 50 is correspondingly changed. That is, depending on the type of the recording material, the charging device 50 is controlled. A modified example of such an output is shown in FIG. 11. With an increase in basis weight of the paper, the paper-sharing voltage is increased, so that the secondary transfer voltage is set at a larger value. Correspondingly, the amount of the current passing through the patch portion is increased, so that a total amount of the current for the charging device is set at a larger value.

Second Embodiment

Second Embodiment of the present invention will be described with reference to FIGS. 12 and 13. First, the image forming apparatus in this embodiment includes, as shown in FIG. 12, a cleaning device 120 of a blade for cleaning the intermediary transfer belt 6. That is, the blade is contacted to and slid on the intermediary transfer belt 6 to remove the toner from the intermediary transfer belt 6. Other constitutions except for a charging device 50A described below are the same as those in First Embodiment described with reference to FIG. 1.

The charging device 50A is, as shown in FIG. 13, constituted by a charging roller. That is, the charging roller is disposed at a position in which the charging roller opposes the patch β on the intermediary transfer belt 6, and the charge amount of the patch β is changed by applying a voltage from the power source 52 to the charging roller. In this embodiment, the charging device 50A is controlled depending on the density of the patch β detected by the patch sensor 17, a detection result of the environment sensor 30 and the size of the recording material 7. Other structures and functions are the same as those in First Embodiment.

Embodiment 2

A specific embodiment in Second Embodiment will be described. In this embodiment, the charging device (charging roller) 50A is a sponge roller prepared by disposing an elastic member such as sponge on the peripheral surface of a core metal. This roller has a length of 50 mm in which the patch is covered with respect to the widthwise direction, and is 20 mm in outer diameter, 4 mm in thickness of the sponge, and $10^6$ to $10^8\Omega$ in resistance. Further, to the charging roller, a positive bias can be applied. In this embodiment, the voltage of 2 kV is applied when the patch passes through the charging roller. An opposite stretching roller 51 is constituted by a rubber tube of 20 mm in outer diameter and 1 mm in thickness and has a resistance of $10^4$-$10^5\Omega$ and is grounded. The bias sequence of the charging device 50A is also the same as that in Embodiment 1.

Third Embodiment

Third Embodiment of the present invention will be described with reference to FIG. 14 to FIG. 17. A basic constitution in this embodiment is the same as that in First Embodiment or Second Embodiment described above. In this embodiment, the temperature and humidity are detected by the environment sensor 30 (FIG. 1) and depending on the detected environment, a value of the current applied to the charging device 50 is set.

Embodiment 3

FIG. 14 is a flow chart in this embodiment. A difference from the flow chart in FIG. 4 is that a temperature and humidity detecting step (S21) is provided and the environment is set at a level closest to any one of HH (30° C., 80% RH), NN (23° C., 50% RH) and NL (23° C., 5% RH). Subsequent steps are the same as those in FIG. 4. The triboelectric charge distribution in each environment is shown in FIG. 15. The center value in each environment is −30 μC/g in HH environment, −40 μC/g in NN environment and −50 μC/g in NL environment.

FIG. 16 is a table showing a relationship among patch input signals and currents of the charging device 50 in the respective environments. Each column represents the current values when the temperature and humidity environment is changed and each row represents the current values when the patch input signal (density) is changed. Depending on each environment, the charger current is set. As a basic currant setting, the current is increased when the charge amount (toner amount) per unit area is large (the case where the density is high) and is decreased when the charge amount is small (the case where the density is low). Further, the current is increased when the patch charge amount is large (the case where the water content in the air is small) and is decreased when the patch charge amount is small (the case where the water content in the air is large). Further, in the case where the effect cannot be obtained by excessively decreasing the current, the lower limit is set. In the case where the effect cannot be obtained, the upper limit is set. For example, when the patch input signal is C0*h* or B0*h*, the change in effect is small even when the current amount is made larger than −4 μA in HH environment, −6 μA in NN environment and −8 μA in NL environment when the patch input signal is C0*h* or B0*h*, and therefore the above current amounts are set at the upper limit. Further, in HH environment, in the case where the current amount is made smaller than −2 μA when the patch input signal is 30*h*, 30*h* or 10*h*, the effect cannot be obtained and therefore the lower limit is set at −2 μA.

Effect

FIG. 17 is a table showing the effect of the present invention in each of the embodiments since the same effect is achieved in all the embodiments of the present invention. Checking of the effect was made by using the image forming apparatus shown in FIG. 1 in the following manner. In a state in which the patch was formed at the side of the A3-sized output image with respect to the longitudinal direction, the overlarge-sized paper was passed after a predetermined number of the A3-sized sheets were passed and then a degree of the back-side (surface) contamination of the paper was checked. When the overlarge-sized paper was passed, the charging device was turned off.

In the case where the patch β was not charged, the back-side contamination occurred after the passing of 10 sheets. On the other hand, as in the respective embodiments, in the case where the patch β was charged, the back-side contamination did not occur even after the passing of 1,000 sheets. That is, it can be said that the constitutions in the present invention are effective in suppression of the occurrence of the back-side contamination.

Fourth Embodiment

In this embodiment, a charging device 500 as the charge amount changing means is used in place of the charging device 50. Other constitutions are the same as those in the above embodiments.

Charge Amount Changing Means

In this embodiment, between the secondary transfer position and the patch sensor 17, the charging device 500 (charge amount changing means) for changing the charge amount of each of the normal image α and the patch β which are transferred on the intermediary transfer belt 6 is disposed. That is, with respect to the rotational direction, the charging device 500 is disposed, upstream of the secondary transfer roller 9 and downstream of the patch sensor 17, so as to oppose the outer peripheral surface (image transferred surface) of the intermediary transfer belt 6. Further, an opposite roller 51 is disposed, in contact with the intermediary transfer belt 6, at a position in which the roller 51 oppose the charging device 50 via the intermediary transfer belt 6.

Such a charging device 500 includes a charger 500*a* and a shutter 500*b*. In this embodiment, the charger 500*a* is a corona charger and has a width such that the charger 500*a* opposes both of the normal image α and the patch β which are transferred on the intermediary transfer belt 6. Further, between the charger 500*a* and the intermediary transfer belt 6, the shutter 500*b* which is slidably movable is disposed. In an example as shown in FIG. 22, the charger 500*a* is disposed so as to cover the entire width area of the intermediary transfer belt 6 and the shutter 500*b* is disposed so as to oppose the normal image α as shown in FIG. 22 and (*a*) of FIG. 23. Further, by moving the shutter 500*b* in a direction (arrow K direction in (*a*) of FIG. 23) along the rotational direction of the intermediary transfer belt 6, the portion of the charger 500*a* opposing the normal image α can be freely opened and closed. In other words, the shutter 500*b* does not cover the portion of the charger 500*a* opposing the patch β but is opened and closed at the portion opposing the normal image α.

A moving mechanism 52 for slidably moving such a shutter 500*b* moves the shutter 500*b*, as shown in (*b*) of FIG. 23, by engagement between a pinion 52*a* rotated by an unshown motor and a rack 52*b* provided on the shutter 500*b*. That is, the pinion 52*a* is rotated in an arrow direction, so that the rack 52*b* and the pinion 52*a* are engaged with each other to move the shutter 500*b* in an arrow direction. Incidentally, the moving mechanism 52 may also be, in addition to such a rack-and-pinion mechanism, other mechanisms such as a hydraulic actuator, a linear drive actuator and a ball screw mechanism driven by a driving source such as the motor.

In this embodiment, the normal image α and the patch β can be charged by the above-constituted charging device 500. That is, when the shutter 500*b* is opened and the charger 500*a* is turned on, both of the normal image α and the patch β are charged, so that the charge amounts of the both images can be increased. Further, when the shutter 500*b* is closed and the charger 500*a* is turned on, the normal image α is not charged but the patch β can be charged, so that only the charge amount of the patch β can be increased. Further, when the charger 500*a* is turned off, the both images can be prevented from being charged. Further, the charge amounts of the normal image α and the patch β can be lowered by applying an opposite voltage to the charging device 50. Thus, the charge amount of each of the normal image α and the patch β can be changed by on/off control of the charger 500*a*, by changing the applied voltage or by opening and closing the shutter 500*b*.

In the case where the patch β is not charged, the toner with no charge amount is generated at the secondary transfer position and cannot be electrostatically removed. On the other hand, when the patch β is charged to the negative polarity relative to the normal image α at the position upstream of the secondary transfer position, substantially all of the patches β are transferred onto the secondary transfer roller 9 and can be electrostatically removed.

On the other hand, when the charge amount of the normal image α transferred onto the recording material 7 is increased, a transfer efficiency by the secondary transfer bias determined in view of the paper-sharing voltage is lowered since the charge amount is out of a good charge amount range, so that there is a possibility that improper transfer occurs. In this embodiment, it is possible to prevent an increase in charge amount of the normal image α by closing the shutter 500*b*. As a result, the normal image α can be properly transferred onto the recording material 7, and the patch β transferred on the secondary transfer roller 9 can be sufficiently removed and thus contamination of the secondary transfer roller 9 can be suppressed. When the contamination of the secondary transfer roller 9 can be suppressed, a degree of an occurrence of back-side (surface) contamination on the recording material 7 to be subjected to subsequent image formation.

Figure 4:
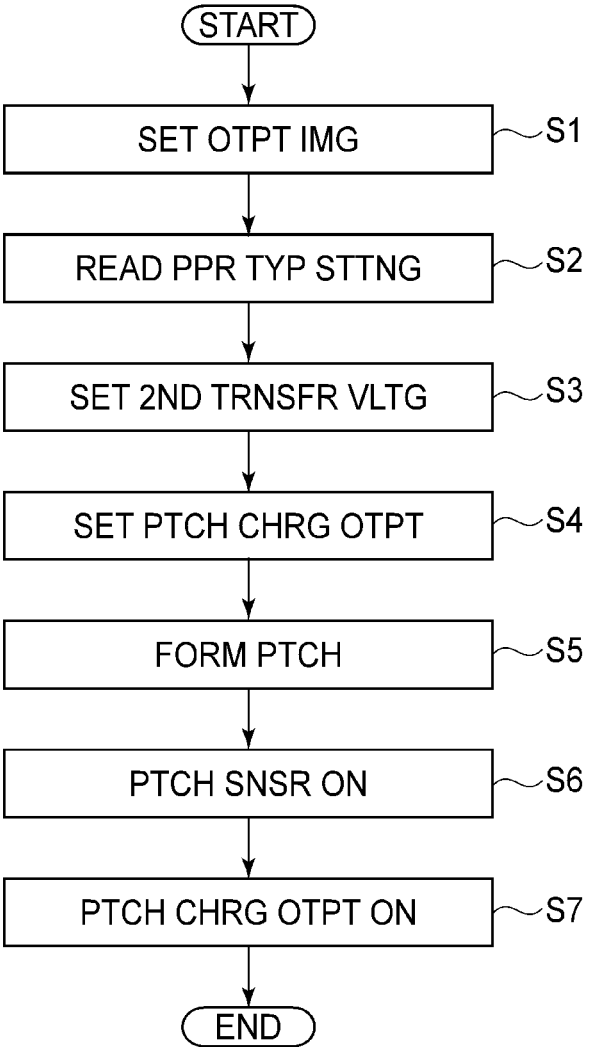
FIG. 4 is a flow chart of control in First Embodiment.

When the operation as shown in FIG. 4 is performed, the shutter 500*b* of the charging device 500 is closed, so that only the patch is charged. On the other hand, depending on the environment in which the image forming apparatus is placed, there is a case where the normal image α may also preferably be charged. Further, depending on the size of the recording material 7, there is a case where the patch β is transferred onto the recording material 7. For this reason, in this embodiment, the environment sensor (environment detecting means) 30 for detecting a temperature and humidity in the image forming apparatus is provided. Further, e.g., the paper type setting portion 209 can read not only the paper type but also the size of the recording material 7. As a result, in addition to the above-described control, the opening and closing operation of the shutter 500*b* is performed also by making reference to the environment detected by the environment sensor 30 and the size of the recording material read by the paper type setting portion 209.

For example, in the case where the size of the recording material is the overlarge size such that the area in which the patch β is formed is included and the environment detected by the environment sensor 30 is the high temperature and high humidity environment, the shutter 500*b* is opened and both of the normal image α and the patch β are charged by the charger 500*a*. This is because the toner charge amount is liable to become low in the high temperature and high humidity environment and the patch B is transferred onto the recording material 7 and therefore the transfer condition of each of the patch β and the normal image α is the same (there is no difference in paper-sharing voltage component). As a result, the transfer efficiency for transferring the normal image α and the patch β onto the recording material 7 can be improved, so that the amount of the toner remaining on the intermediary transfer belt 6 can be decreased and the cleaning by the cleaning device can be satisfactorily performed.

Embodiment 4

Next, a specific embodiment in Fourth Embodiment will be described.

In this embodiment, the patches having the above-described constitutions are transferred onto the secondary transfer roller 9 and are removed by the secondary transfer portion cleaning device 60. Further, in this embodiment, the shutter 500*b* shown in FIG. 22 is constituted by an electroconductive material and is in a closed state. Further, in this embodiment, the charger 50 is the corona charger of 360 mm in width and is constituted so that ion current flowing from the charger 500*q* is partly blocked by the shutter 500*b* and ion current passing through an opening of 25 mm in which cover the entire patches with respect to the longitudinal direction but does not cover the output image. Further, the current passing through the opposite roller 51 of the charger 500*a* is −6 μA and a voltage applied to a shield of the charger 500*a* and to the shutter 500*b* is 0.1 kV. In this embodiment, the patch is not formed at the sheet interval and therefore the charger 500*a* is turned on at the leading end of the first sheet and kept in the on state since the sheet interval during continuous sheet passing is short, and is turned off when a large sheet interval is provided, e.g., when potential control of the photosensitive drum 1 is effected.

Further, in the case where the overlarge-sized paper (sheet) is passed, the charger 500*a* is turned off since there are two cases including the case where the patch is transferred onto the paper on the premise that the paper is to be cut and the case where the patch is formed at the sheet interval.

FIG. 24 shows a toner charge amount distribution (triboelectric charge distribution). Measurement was made by using a measuring apparatus ("Espart Analyzer EST-3", mfd. by Hosokawa Micron Corp.) (cyan toner, 3000 counts). In the case of the NN environment (23° C., 50% RH), the triboelectric charge distribution on the intermediary transfer belt 6 is indicated by a dotted line in FIG. 24 and a center value is −40 μC/g. This value is the same with respect to the output image and the patch. The triboelectric charge distribution of the patch in the case where the charger 500*a* is turned off is indicated by a solid line ("UNCHARGED") in FIG. 24, so that the toner with no charge amount is generated in a large amount. Therefore, in the case where the secondary transfer roller 9 is of an electrostatic cleaning type, the toner with substantially no charge amount deposited on the secondary transfer roller 9 cannot be removed, so that back-side contamination can occur in the case where a subsequent overlarge-sized paper is passed.

A curve indicated by a chain double-dashed line represents the triboelectric charge distribution of the patch in the case where the charging device 50 is turned on. The center value is about −60 μC/g which is larger than that of the output image by about 20 μC/g in terms of an absolute value. In this state, when the patch reaches the secondary transfer roller 9 to which the high transfer voltage is applied, the charge amount of the patch is substantially balanced with the amount of the current, passing through an area other than the paper area, applied to the secondary transfer roller 9. Further, the toner with no charge amount does not occur and therefore all the patches can be transferred onto the secondary transfer roller 9 and can be then removed by the electrostatic cleaning.

Incidentally, in this embodiment, A3-sized paper is used in NN environment and therefore the shutter 500*b* is in the closed state. In the case where, e.g., the overlarge-sized paper is used in HH environment, the shutter 500*b* is placed in an open state. Further, in the image forming apparatus in this embodiment, the type of the paper can be designated by the user, and a value of the secondary transfer bias applying means 28 is changed depending on the type (basis weight) of the paper, so that the output of the charger 500*a* is correspondingly changed. That is, depending on the type of the recording material, the charging device 50 is controlled.

Fifth Embodiment

Fifth Embodiment of the present invention will be described with reference to FIGS. 25 and 26. First, the image forming apparatus in this embodiment includes, as shown in FIG. 25, a cleaning device 120 of a blade for cleaning the intermediary transfer belt 6. That is, the blade is contacted to and slid on the intermediary transfer belt 6 to remove the toner from the intermediary transfer belt 6. Other constitutions except for a charging device 500A described below are the same as those in First Embodiment described with reference to FIG. 1.

The charging device 500A, as shown in FIG. 26, includes two shutters 500*c* and 500*d* for opening and closing the charger 500*a*. Of these shutters, the shutter 500*c* is disposed opposed to the area in which the normal image α shown in FIG. 22 is formed, and the shutter 500*d* is disposed opposed to the area in which the patch β shown in FIG. 22 is formed. Each of the shutters 500*c* and 500*d* is independently movable in the opening and closing direction. In this embodiment, the charging device 500A is controlled depending on the density of the patch β detected by the patch sensor 17, a water content in air using a detection result of the environment sensor 30 and the size of the recording material 7. Other structures and functions are the same as those in First Embodiment. Incidentally, the water content in the air is larger in the order of HH>NN>NL.

Embodiment 5

A specific embodiment in Fifth Embodiment will be described. As shown in FIG. 26, the shutter 500*c* of the charging device 500A is used for the output image portion of 335 mm in width, and the shutter 500*d* is used for the patch portion of 25 mm in width. In the following, four states (1) to (4) based on combination of opening and closing of these (two) shutters 500*c* and 500*d*.

(1) Shutter 500*c*:open and shutter 500*d*:open

In this case, as after the image formation on $500\times10^3$ sheets in HH environment, in the case where the toner charge amount is low (center value: about −10 μC/g) and the patch is formed on the overlarge-sized paper as the recording material, the charge amounts of the normal image and the patch are intended to be increased. Incidentally, this combination may also be applied to the case where the patch is formed at the sheet interval. By turning the charger 500*a* on and by setting the current passing through the opposite roller 51 at −60 μA and the shield voltage at 1 kV, the toner charge amount is increased up to about −30 μC/g (center value), so that good transfer can be effected.

(2) Shutter 500*c*:closed and shutter 500*d*:open

In this case, as in NN environment, in the case where the toner charge amount is normal (center value: about −4 μC/g) and the patch is formed at the position spaced from and at the side of the recording material up to the large size (297×420 mm), the charge amount of the patch is intended to be increased. By turning the charger 500*a* on and by setting the current passing through the opposite roller 51 at −6 μA and the shield voltage at 1 kV, the patch charge amount is increased up to about −60 μC/g (center value) as indicated by the chain double-dashed line in FIG. 24, so that good transfer of the patch β onto the secondary transfer roller 9 can be effected.

(3) Shutter 500*c*:open and shutter 500*d*:closed

In this case, as in NL environment (23° C., 5% RH), in the case where the toner charge amount is higher (center value: about −6 μC/g) than those in FIG. 29 and the patch is formed at the position spaced from and at the side of the recording material up to the large size (297×420 mm), the charge amounts of the image and the patch are intended to be decreased. By turning the charger 500*a* on and by setting the current passing through the opposite roller 51 at 41.7 μA and the shield voltage at 1 kV, the patch charge amount is decreased down to about −50 μC/g (center value), so that good transfer can be effected.

(4) Shutter 500*c*:closed and charge 500*d*:closed

In this case, as in NN environment, the toner charge amount is normal (center value: about −40 μC/g) and the recording material size is not limited, and the patch is formed at the sheet interval as shown in FIG. 24. There is a possibility that the wire of the charger 500*a* is contaminated due to scattering of the toner. Therefore, in the case where the off state of the charger 500*a* is continued for a time, the shutters 500*c* and 500*d* are closed and thus the contamination of the wire is prevented.

FIG. 27 is a flow chart in the case of the recording material up to the large size, i.e., the case where the patch can be formed at the side of the normal image. First, an unshown potential sensor is disposed, upstream and downstream of the developing device 4, on the photosensitive drum 1. From the potentials before and after the formation of a solid patch and the toner amount per unit area (mg/cm$^2$), the toner charge amount (μC/g) is obtained (S11). Here, the toner amount per unit area is estimated from a detection result of the patch sensor 17. When the center value of the toner charge amount is larger than −50 μC/g in terms of the absolute value (S12), the shutter 500*c* is opened and the shutter 500*d* is closed, so that the operation goes to the same control step as that in FIG. 4. Here, a bias of the opposite polarity is applied to the charger 500*a*, so that the charge amount of the normal image is lowered. When the center value of the toner charge amount is not larger than −50 μC/g in terms of the absolute value (S13), the shutter 500*c* is closed and the shutter 500*d* is opened, so that the operation goes to the same control step as that in FIG. 4. Here, a bias of the positive polarity is applied to the charger 500*a*, so that the charge amount of the patch is increased.

FIG. 28 is a flow chart in the case of the recording material of the overlarge size, i.e., the case where the patch cannot be formed at the side of the normal image (output image). First, an unshown potential sensor is disposed, upstream and downstream of the developing device 4, on the photosensitive drum 1. From the potentials before and after the formation of a solid patch and the toner amount per unit area (mg/cm$^2$), the toner charge amount (μC/g) is obtained (S21). Here, the toner amount per unit area is estimated from a detection result of the patch sensor 17. When the center value of the toner charge amount is larger than −20 μC/g in terms of the absolute value (S12), the shutter 500*c* is closed and the shutter 500*d* is closed, so that the operation goes to the same control step as that in FIG. 4. When the center value of the toner charge amount is not larger than −20 μC/g in terms of the absolute value (S13), the shutter 500*c* is opened and the shutter 500*d* is also opened, so that the operation goes to the same control step as that in FIG. 4. Here, a bias of the positive polarity is applied to the charger 500*a*, so that the charge amount of the output image is increased.

Sixth Embodiment

Sixth Embodiment of the present invention will be described with reference to FIG. 30. In this embodiment, a charging device 5000 does not include, different from those in the above embodiments, the shutter structure but includes two chargers 501 and 502. These chargers 501 and 502 are, as shown in FIG. 30, different in widthwise dimension. The smaller charger 501 is disposed at the position in which the charger 501 opposes the patch β, and the larger charger 502 is disposed so as to oppose the normal image d and the patch β. These chargers 501 and 502 are disposed side by side with respect to the rotational direction of the intermediary transfer belt 6.

For that reason, in the case where the bias is applied to both of the chargers 501 and 502, the patch β is charged by both of the chargers 501 and 502 and the normal image α is charged by the charger 502. Further, in the case where the bias is applied to only the charger 501, only the patch β is applied to only the charger 501, only the patch β is charged by the charger 501. Further, in the case where the bias is applied to only the charger 502, the normal image α and the patch β are charged by the charger 502. Therefore, by effecting ON/OFF control of these chargers 501 and 502, each of the charge amounts of the normal image α and the patch β can be changed. Incidentally, the width of the charger 502 is decreased and thus only the normal image α may be charged by the charger 502. Other structures and functions are the same as those in Fourth and Fifth Embodiments.

Other Embodiments

The structure of the image forming apparatus to which the present invention is applicable is not limited to that of the tandem type as shown in FIG. 1 and FIG. 12. For example, as shown in FIG. 18 and FIG. 19, the present invention is also applicable to a one-drum type image forming apparatus. In FIGS. 18 and 19, a single photosensitive drum is used and a drum 40 for rotationally driving develop devices 4Y, 4M, 4C and 4*k* is provided. In the case where each color is formed, the drum 50 is rotated to switch the associated develop device opening the photosensitive drum 1. Incidentally, the electrostatic cleaning means for cleaning the secondary transfer roller 9 is omitted. Other structures and functions are the same as those of the image forming apparatus of the tandem type shown in FIGS. 1 and 12.

As described above, according to the present invention, the control image is formed adjacently to the normal image, so that it is possible to form a plurality of control images without increasing the density detecting means in number. For this reason, the control of the density and gradation of the output image can be effected with high accuracy. Further, the charge amount of the control image can be changed by the charging means, so that the charge amount of the control image can be adjusted at a proper level even when the control image is formed adjacently to the normal image. Further, the control image transferred onto the transfer portion can be sufficiently removed by the electrostatic cleaning means, so that the contamination of the transfer portion can be suppressed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 170286/2010 filed Jul. 29, 2010 and 170287/2010 filed Jul. 29, 2010, which are hereby incorporated by reference.

What is claimed is:

1. An image forming apparatus comprising:

an image bearing member;

image forming means for forming a toner image on said image bearing member, said image forming means being capable of forming an image to be formed on a recording material and forming a control image for controlling an image density at a position adjacent to the image to be formed on the recording material;

an intermediary transfer member rotatable while carrying the toner image transferred from said image bearing member;

a transfer member for forming a transfer portion where the toner image is to be transferred from said intermediary transfer member onto the recording material;

electrostatic cleaning means for electrostatically removing the toner deposited on said transfer member;

density detecting means, provided upstream of said transfer member with respect to a rotational direction of said intermediary transfer member, for detecting a density of the control image transferred on said intermediary transfer member;

adjusting means for adjusting an image forming condition of said image forming means depending on an output of said density detecting means; and charge amount changing means for adjusting a charge amount of the control image transferred onto said intermediary transfer member.

2. An apparatus according to claim 1, wherein said charge amount changing means is provided between the transfer portion and said density detecting means.

3. An apparatus according to claim 1, wherein when a basis weight of the recording material is increased, said charge amount changing means adjusts the charge amount of the control image by increasing an amount of a current, of an identical polarity to a normal charge polarity of the toner, passing through said charge amount changing means.

4. An apparatus according to claim 1, wherein when an amount of the toner per unit area for the control image is large, said charge amount changing means adjusts the charge amount of the control image by increasing an amount of a current, of an identical polarity to a normal charge polarity of the toner, passing through said charge amount changing means.

5. An apparatus according to claim 1, further comprising environment detecting means for detecting a water content in air in said image forming apparatus, wherein when the water content in the air is small, said charge amount changing means adjusts the charge amount of the control image by increasing an amount of a current, of an identical polarity to a normal charge polarity of the toner, passing through said charge amount changing means.

6. An apparatus according to claim 1, further comprising a corona charger and a shutter for covering said corona charger, wherein the charge amount of each of the control image and the toner image to be formed on the recording material is adjustable by using said shutter.

7. An apparatus according to claim 6, wherein said charge amount changing means is capable of executing an operation in a mode in which the charge amount of each of the control image and the toner image to be formed on the recording material is adjusted, an operation in a mode in which the charge amount of the control image is adjusted and the charge amount of the toner image to be formed on the recording material is not adjusted, and an operation in a mode in which the charge amount of the control image is not adjusted and the toner image to be formed on the recording material is adjusted.

* * * * *